US011813761B2

(12) United States Patent
Usuda

(10) Patent No.: US 11,813,761 B2
(45) Date of Patent: Nov. 14, 2023

(54) HANDLE BENDING RAZOR

(71) Applicant: KAI R&D CENTER CO., LTD., Seki (JP)

(72) Inventor: Masashi Usuda, Seki (JP)

(73) Assignee: KAI R&D CENTER CO., LTD., Seki (JP)

( * ) Notice: Subject to any disclaimer, the term of this patent is extended or adjusted under 35 U.S.C. 154(b) by 0 days.

(21) Appl. No.: 18/043,718

(22) PCT Filed: Mar. 22, 2021

(86) PCT No.: PCT/JP2021/011646

§ 371 (c)(1),
(2) Date: Mar. 1, 2023

(87) PCT Pub. No.: WO2022/049813

PCT Pub. Date: Mar. 10, 2022

(65) Prior Publication Data

US 2023/0249370 A1 Aug. 10, 2023

(30) Foreign Application Priority Data

Sep. 4, 2020 (JP) ..... 2020-149243

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01)

(58) Field of Classification Search
None
See application file for complete search history.

(56) References Cited

U.S. PATENT DOCUMENTS 5,093,991 A * 3/1992 Hendrickson ..... B26B 21/521 30/531
5,307,564 A 5/1994 Schoenberg
(Continued)

FOREIGN PATENT DOCUMENTS

JP S58-038194 B 8/1983
JP S61-004279 Y 2/1986
(Continued)

OTHER PUBLICATIONS

International Search Report for PCT/JP2021/011646, dated May 18, 2021, 3 pages.

*Primary Examiner* — Hwei-Siu C Payer
(74) *Attorney, Agent, or Firm* — STERNE, KESSLER, GOLDSTEIN & FOX P.L.L.C.

(57) ABSTRACT

A handle bending razor includes a grip portion, a razor head, and a head coupling portion. The razor head has a blade body, a blade assembly body, a connecting portion, and an elastic support body. The handle bending razor includes a switching mechanism which can change an angle formed by a contact surface and an up-down direction and, when an external force is not applied, switches between a first state in which a neutral angle formed by the contact surface and the up-down direction is a first angle, and the contact surface and the up-down direction become substantially parallel and a second state in which the neutral angle is a second angle larger than the first angle. In the second state, when the external force is applied, the blade assembly body is tiltable to a position where the contact surface and the up-down direction become substantially perpendicular.

8 Claims, 20 Drawing Sheets

(56) References Cited

U.S. PATENT DOCUMENTS

| | | | | |
|---|---|---|---|---|
| 5,526,568 | A * | 6/1996 | Copelan | B26B 21/28 30/531 |
| 7,140,116 | B2 * | 11/2006 | Coffin | B26B 21/225 30/529 |
| 9,731,426 | B2 * | 8/2017 | Kim | B26B 21/4062 |
| 10,406,705 | B2 * | 9/2019 | Liberatore | B26B 21/24 |
| 10,960,561 | B2 * | 3/2021 | Kim | B26B 21/225 |
| 11,034,038 | B2 * | 6/2021 | Chang | B26B 21/08 |
| 2003/0097755 | A1 | 5/2003 | Singh | |
| 2017/0282392 | A1 * | 10/2017 | Maimone | B26B 21/52 |
| 2020/0164536 | A1 * | 5/2020 | Hashimoto | B26B 21/521 |

FOREIGN PATENT DOCUMENTS

| | | | |
|---|---|---|---|
| JP | H06-039648 | Y | 10/1994 |
| JP | 2006204669 | A | 8/2006 |
| JP | 2011005041 | A | 1/2011 |
| JP | 2014528290 | A | 10/2014 |
| JP | 2018526076 | A | 9/2018 |
| JP | 2019524365 | A | 9/2019 |

* cited by examiner

HANDLE BENDING RAZOR

CROSS-REFERENCE TO RELATED APPLICATION

The present application is a National Stage application of International Application No. PCT/JP2021/011646, filed Mar. 22, 2021, and claims benefit from Japan patent application JP 2020-149243, filed on Sep. 4, 2020 which is hereby incorporated in its entirety by reference.

BACKGROUND

Field

An aspect of the present invention relates to an assembled razor.

Description of Related Art

There is known a T-type razor in which inclination of a head with respect to a handle can be changed. Such a T-type razor is disclosed in Patent Literatures 1 and 2, for example. Moreover, there is known a knife whose inclination angle of a blade body with respect to a handle can be adjusted. Such a knife is disclosed in Patent Literature 3, for example.

Patent Literature 1: Japanese Examined Patent Publication No. 1983-38194 Patent Literature 2: Japanese Examined Utility-Model Publication No. 1994-39648 Patent Literature 3: Japanese Examined Utility-Model Publication No. 1986-4279.

SUMMARY

In the T-type razors described in Patent Literatures 1 and 2 described above, inclination of a head with respect to a handle can be selected in accordance with preference of an user. In the knife described in Patent Literature 3 described above, an inclination angle of a blade body with respect to a handle can be adjusted so that the knife can be used more conveniently.

In shaving with a razor, shaving by moving the razor along a direction in which a beard grows is called "forward shaving", and shaving in a direction opposite to the forward shaving, that is, shaving by moving the razor in a direction opposite to the direction in which the beard grows is called "reverse shaving". Though the forward shaving has less burden on a skin, unshaven beard can easily remain. Thus, the concerned about insufficiently shaved portion of beard is solved in many cases by the reverse shaving. When a face is to be shaved with the T-type razor in the forward shaving, the user can easily shave the face easily by manipulating the T-type razor in a state where the handle extends to a lower direction. On the other hand, when the face is shaved with the T-type razor in the reverse shaving, the user can shave the face easily by manipulating the T-type razor in a state where the handle extends to an upper direction. That is, when the forward shaving and the reverse shaving are to be switched, an easy shaving state can be realized for the user by re-holding the razor. An object of the present invention is to provide a razor which can perform the forward shaving and the reverse shaving easily without re-holding the handle upside-down.

In general, the beard grows from a skin surface to a diagonally lower direction in many cases. Thus, in general, the shaving by moving the razor from an upper side to a lower side is the "forward shaving", and the shaving by moving the razor from the lower side to the upper side is the "reverse shaving". Therefore, in this Description, it is explained that, when a cheek is shaved, the shaving by moving the razor from the upper side to the lower side is referred to as the "forward shaving", and the shaving by moving the razor from the lower side to the upper side as the "reverse shaving". In the case of shaving under the chin, it is explained that the shaving by moving the razor toward a direction getting closer to the neck is referred to as the "forward shaving", and the shaving by moving the razor toward a direction moving away from the neck as the "reverse shaving".

In order to solve the problem described above, the present invention provides a razor with the following configuration. In the explanation below, signs and the like in the drawings are added with parentheses in some cases in order to facilitate understanding of the invention, but each constituent element of the present invention is not limited to these specific configurations but should be interpreted widely to a range that persons skilled in the art can technically understand.

One means of the present invention is a handle bending razor, which is a razor including a grip portion (10) extending in an up-down direction and capable of being gripped by an user, a razor head (70), and a head coupling portion (30) coupled with an upper end (10*g*) of the grip portion, rotatably around a rotating shaft (61) extending in a left-right direction crossing the up-down direction and coupled with the razor head, the razor head having:

a blade body (80) with the left-right direction as a longitudinal direction;

a blade assembly body (74) having a contact surface (74*a*) brought into contact with a skin of the user together with the blade body and to which the blade body is assembled;

a connecting portion (76) connected to the head coupling portion; and an elastic support body (75) which is provided between the connecting portion and the blade assembly body and supports the blade assembly body tiltably in a front-back direction crossing the up-down direction and the left-right direction, in which a switching mechanism (50) which can change an angle formed by the contact surface and the up-down direction by an operation by the user and a switching mechanism (50) and, when the blade assembly body is at a neutral position where an external force is not applied, switches between a first state in which a neutral angle formed by the contact surface and the up-down direction is a first angle ($\alpha f$), and the contact surface and the up-down direction become substantially parallel and a second state in which the neutral angle is a second angle ($\alpha s$) larger than the first angle is provided; and in the second state, when the external force is applied, the blade assembly body is tiltable to a position where the contact surface and the up-down direction become at least substantially perpendicular.

According to the handle bending razor with the aforementioned configuration, when the user shaves the cheek in the forward shaving, for example, by having the first state in which the contact surface and the up-down direction become substantially parallel, the contact surface can be moved on the skin of the user's cheek in the state where the grip portion extends to a lower direction.

Moreover, when the user shaves under the chin in the forward shaving, for example, by having the second state in which the neutral angle is the second angle larger than the first angle, that is, by having the second state in which the contact surface is directed diagonally upward, when the blade assembly body is at the neutral position, the contact surface can be brought into close contact with the skin under the user's chin without interference of the lower end of the grip portion with the user's body and in the state where the grip portion extends to the lower direction. Then, when the user applies a force to the grip portion so as to press the contact surface to the skin, the blade assembly body is tilted to the position where the contact surface and the up-down direction are substantially perpendicular, and the contact surface can be reliably brought into close contact with the skin under the user's chin while the lower end of the grip portion is separated away from the user's body and in the state where the grip portion extends to the lower direction. When the user moves the razor to a front side in this state, the contact surface can be moved in close contact on the skin under the chin and in the state where the grip portion extends to the lower direction.

Moreover, when the user shaves the cheek in the reverse shaving, for example, by having the second state, a part of the contact surface, that is, the upper end, for example, can be brought into contact with the skin on the user's cheek in the state where the grip portion extends to the lower direction. And when the user applies a force to the grip portion so as to press the contact surface to the skin, the blade assembly body is tilted to the position where the contact surface and the up-down direction become substantially perpendicular, and the contact surface can be brought into close contact with the skin on the user's cheek in the state where the grip portion extends to the lower direction. When the user moves the razor to a front side in this state, the contact surface can be moved on the skin of the user's cheek in the state where the grip portion extends to the lower direction.

Moreover, when the user shaves under the chin in the reverse shaving, for example, by having the second state, the user can bring the contact surface into close contact with the skin under the user's chin in the state where the grip portion extends to the lower direction without raising an elbow much. When the user moves the razor to the front side, too, the contact surface can be moved in close contact on the skin under the user's chin in the state where the grip portion extends to the lower direction. When the user shaves under the chin in the reverse shaving, even in the first state, the contact surface can be brought into close contact with the skin under the user's chin in the state where the grip portion extends to the lower direction. However, in the case of reverse shaving under the chin in the second state, the user can shave without raising the elbow much and thus, the shaving under the chin can be more comfortable.

That is, in both the forward shaving and the reverse shaving, the contact surface can be moved on the user's skin and on the skin under the chin in the state where the grip portion extends to the lower direction. Therefore, the forward shaving and the reverse shaving can be performed easily without a need for the user to re-hold the grip portion so that the grip portion extends to the upper direction.

In the aforementioned handle bending razor, it is preferable that the first angle ($\alpha f$) is 5° or more and 25° or less; in the second state, when an external force is applied, the blade assembly body is tiltable so that the angle formed by the contact surface and the up-down direction becomes 80° or more.

According to the handle bending razor with the aforementioned configuration, in the first state, when the user shaves the cheek in the forward shaving, the neutral angle suitable for the contact surface to be brought into contact with the user's cheek in the state where the grip portion extends to the lower direction can be realized.

In the second state, by means of tilting of the blade assembly body so that the angle formed by the contact surface and the up-down direction becomes 80° or more, when the user shaves under the chin in the forward shaving, the state in which the contact surface is reliably in close contact with the skin under the user's chin can be realized in the state where the lower end of the grip portion is separated away so as not to contact the user's body and the grip portion extends to the lower direction. Moreover, when the user shaves the cheek and under the chin in the reverse shaving, the state in which the contact surface is in close contact with the skin on the user's cheek can be realized in the state where the grip portion extends to the lower direction.

In the handle bending razor, it is preferable that the switching mechanism (50):

has an operation portion (52*c*) exposed to an outer side of the grip portion and includes a movable body (52) which moves moving between a first position where the first state is maintained and a second position where the second state is maintained;

the movable body has movement from the first position to the second position regulated; and the regulation on the movement of the movable body from the first position to the second position is released when the operation portion is pressed down by the user.

According to the handle bending razor with the aforementioned configuration, when the razor is moved to the front side in use, even if the external force which moves the blade assembly body from the position in the first state to the position in the second state is applied to the blade assembly body, since the movement of the movable body is regulated, an unexpected change of the razor in the first state to the second state can be suppressed. As a result, the razor can be stably used. Moreover, the user can cause the razor to change from the first state to the second state with a simple operation of pressing down the operation portion.

In the aforementioned handle bending razor, it is preferable that a difference between the second angle and the first angle is 20° or more and 40° or less.

According to the handle bending razor with the aforementioned configuration, the angle of the contact surface suitable for the forward shaving of the cheek in the first state is realized, and the angle of the contact surface suitable for the forward shaving and reverse shaving under the chin and the reverse shaving of the cheek in the second state can be realized.

In the aforementioned handle bending razor, it is preferable that in the grip portion, a groove (10*f*) accommodating a part of the movable body is formed along the up-down direction, and a width in the left-right direction of the operation portion is larger than a width in the left-right direction of the groove.

According to the handle bending razor with the aforementioned configuration, operability of the operation portion by the user can be improved by such a configuration that the operation portion exposed to the outer side of the grip portion is widened in the left-right direction.

In the aforementioned handle bending razor, it is preferable that in the first state, a first direction (V1) from the rotating shaft to the elastic support body is substantially parallel to a direction in which the grip portion extends, and in the second state, a second direction (V2) from the rotating shaft to the elastic support body is directed to a rear side (Z-axis+side), which is a side opposite to the front side (Z-axis–side) to which a blade edge of the blade body in the first state can be exposed as compared with the first direction.

According to the handle bending razor with the aforementioned configuration, in the first state, since the grip portion and the head coupling portion can be configured to integrally extend in the up-down direction, the handle bending razor can have a simple shape similar to general razors, and the handle bending razor can be used with a sense of use equal to that of the general razors. Moreover, in the second state, the blade assembly body can be located on the rear side from an extension line on the upper side of the grip portion so as to be suitable for the forward shaving and the reverse shaving under the chin and the reverse shaving on the cheek.

In the aforementioned handle bending razor, it is preferable that the grip portion has a part (10*a*) recessed on the front side where the blade edge of the blade body in the first state can be exposed between the upper end and the lower end (10*h*) of the grip portion on a plan view from the left-right direction.

According to the handle bending razor with the aforementioned configuration, it is easier to put the ball of a finger of the user on the grip portion, that is, to place it. As a result, since the user can hold the grip portion in a state where the user bends some fingers (closed state), shaving can be performed stably without shaking. That is, ease of holding the razor and operability can be improved.

In the aforementioned handle bending razor, it is preferable that in the grip portion, at least a part of an outer periphery between the upper end and a lower end of the grip portion is smaller than an outer periphery of the lower end.

According to the handle bending razor with the aforementioned configuration, by forming a part which becomes thicker as it goes toward the lower side and is not slippery when the user applies a force so as to move the handle bending razor to the lower side, the handle bending blade having a grip portion shape which is easy to be held and is not slippery can be provided.

DETAILED DESCRIPTION

Figure 1:
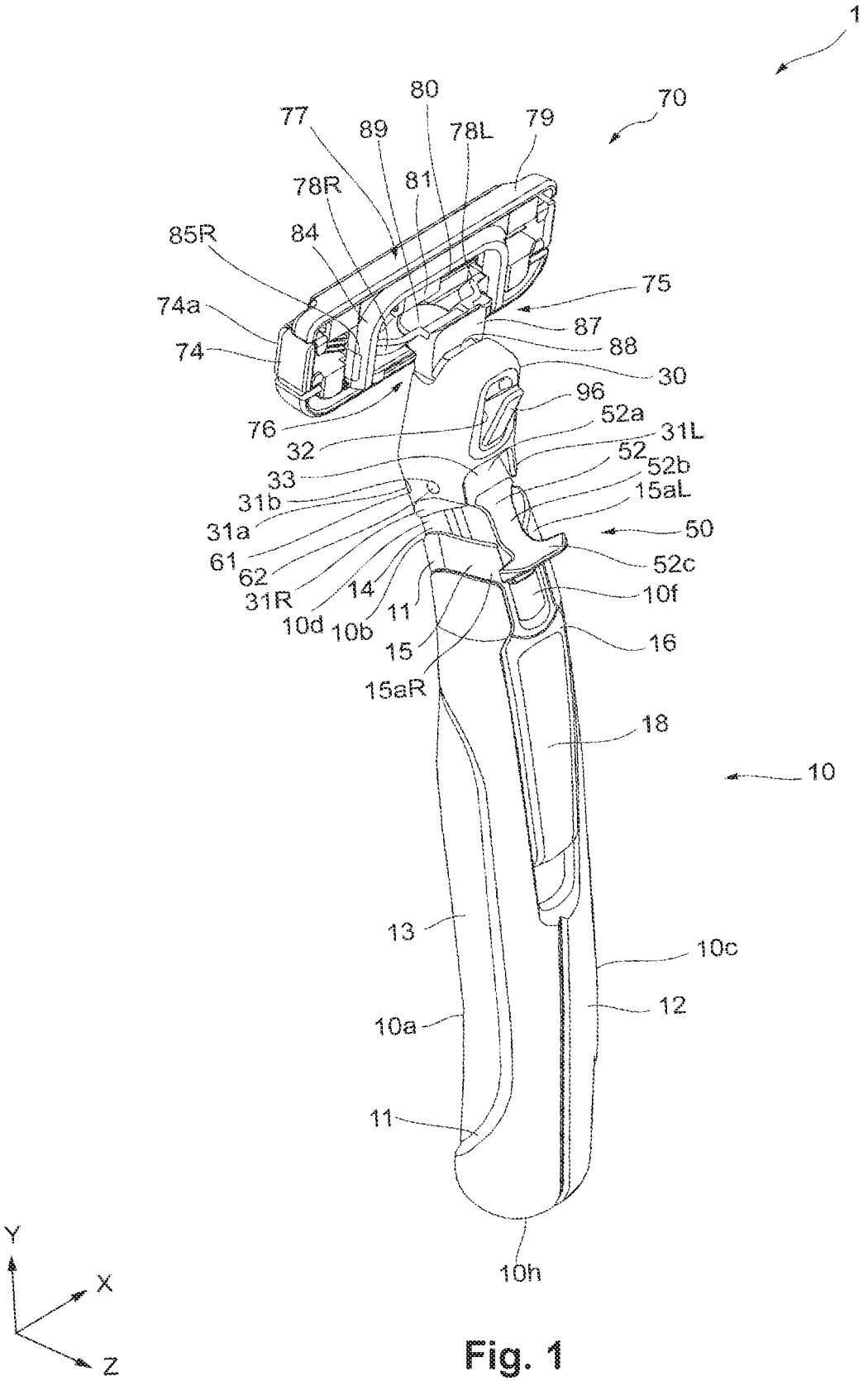
FIG. 1 is a perspective view of a handle bending razor in a before-bending state of this embodiment, when viewed from a rear right side.

A handle bending razor of an aspect of the present invention is characterized by a configuration which enables an user to perform forward shaving and reverse shaving in a state where a grip portion of the razor extends to a lower direction. Specifically, the handle bending razor is capable of switching the handle to a bent state and is characterized in that, in a before-bending state, a contact surface brought into contact with a skin of an user together with a blade body and an up-down direction become substantially parallel, and in the bent state, when an external force is applied, the blade assembly body is configured to be tiltable to a position where the contact surface and the up-down direction are at least substantially perpendicular.

The handle bending razor of the present invention will be specifically explained by referring to the drawings. However, embodiments and examples which will be explained below are only examples of the present invention and are not intended to interpret a technical scope of the present invention in a limited manner. It is to be noted that, in each drawing, the same signs are given to the same constituent elements, and explanation thereof will be omitted in some cases.

1. Embodiment

<Configuration of Handle Bending Razor 1>

Figure 2:
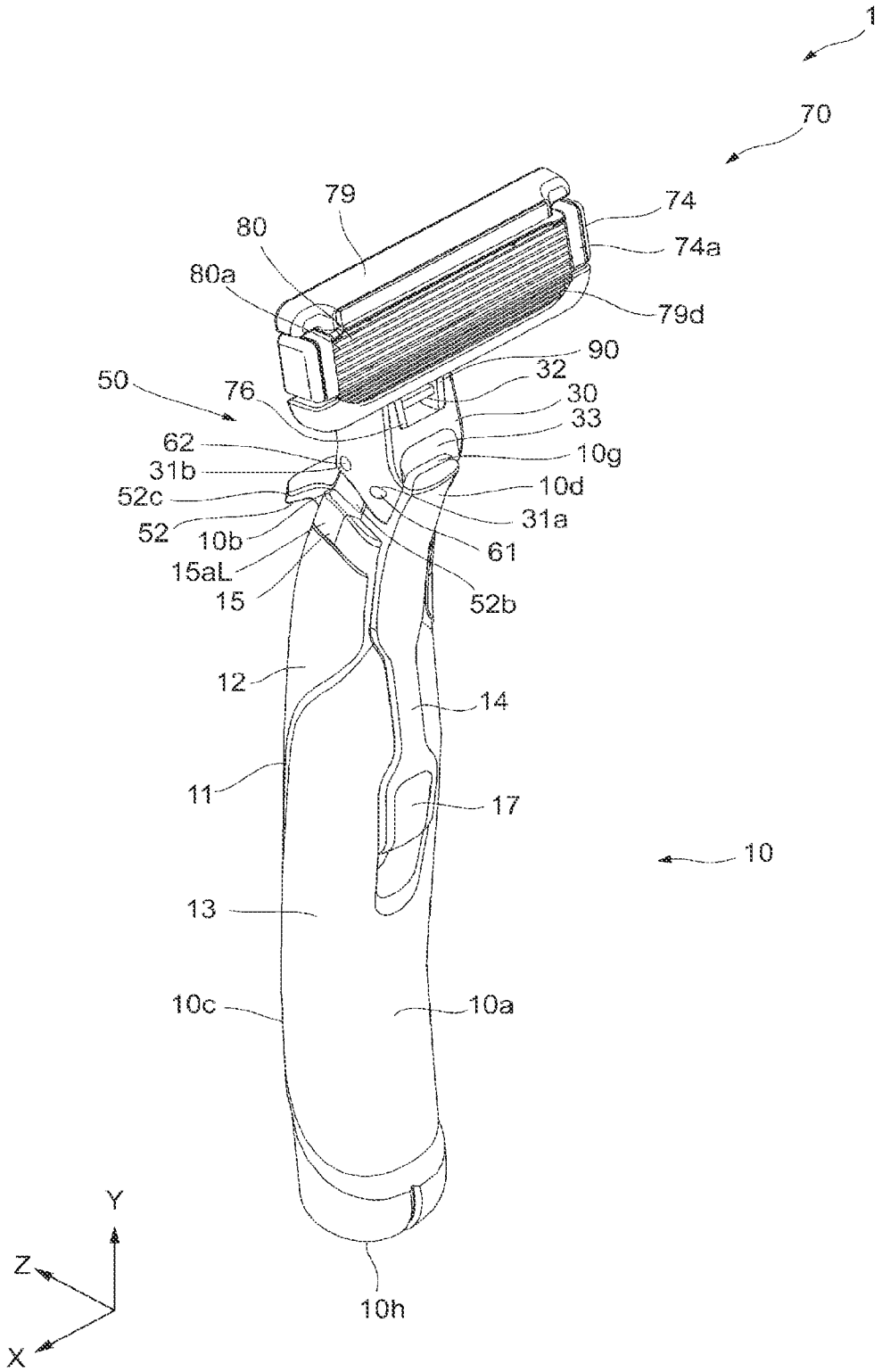
FIG. 2 is a perspective view of the handle bending razor in the before-bending state of this embodiment, when viewed from a front left side.
Figure 3:
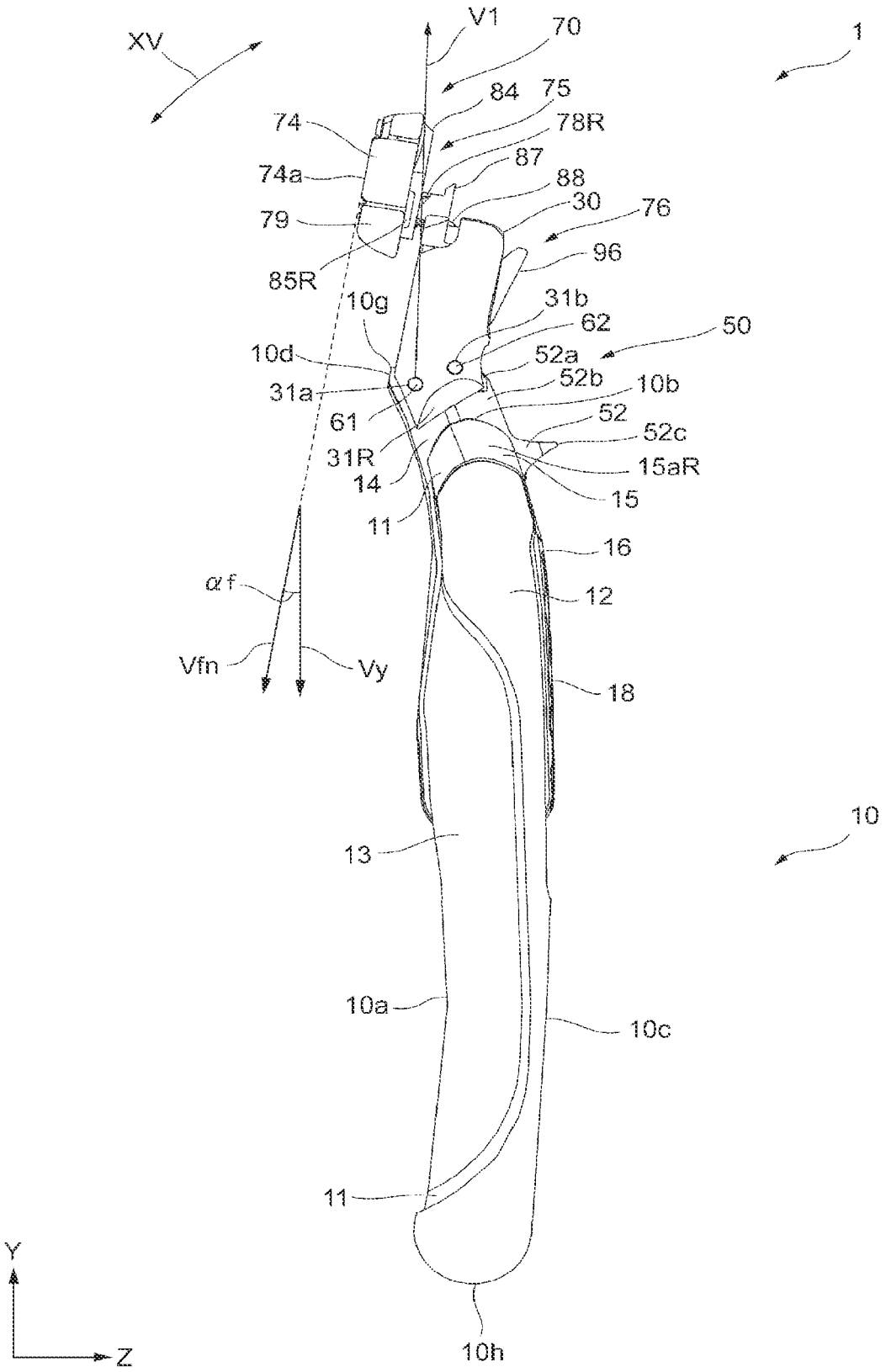
FIG. 3 is a plan view of the handle bending razor in the before-bending state of this embodiment, when viewed from a right side.
Figure 4:
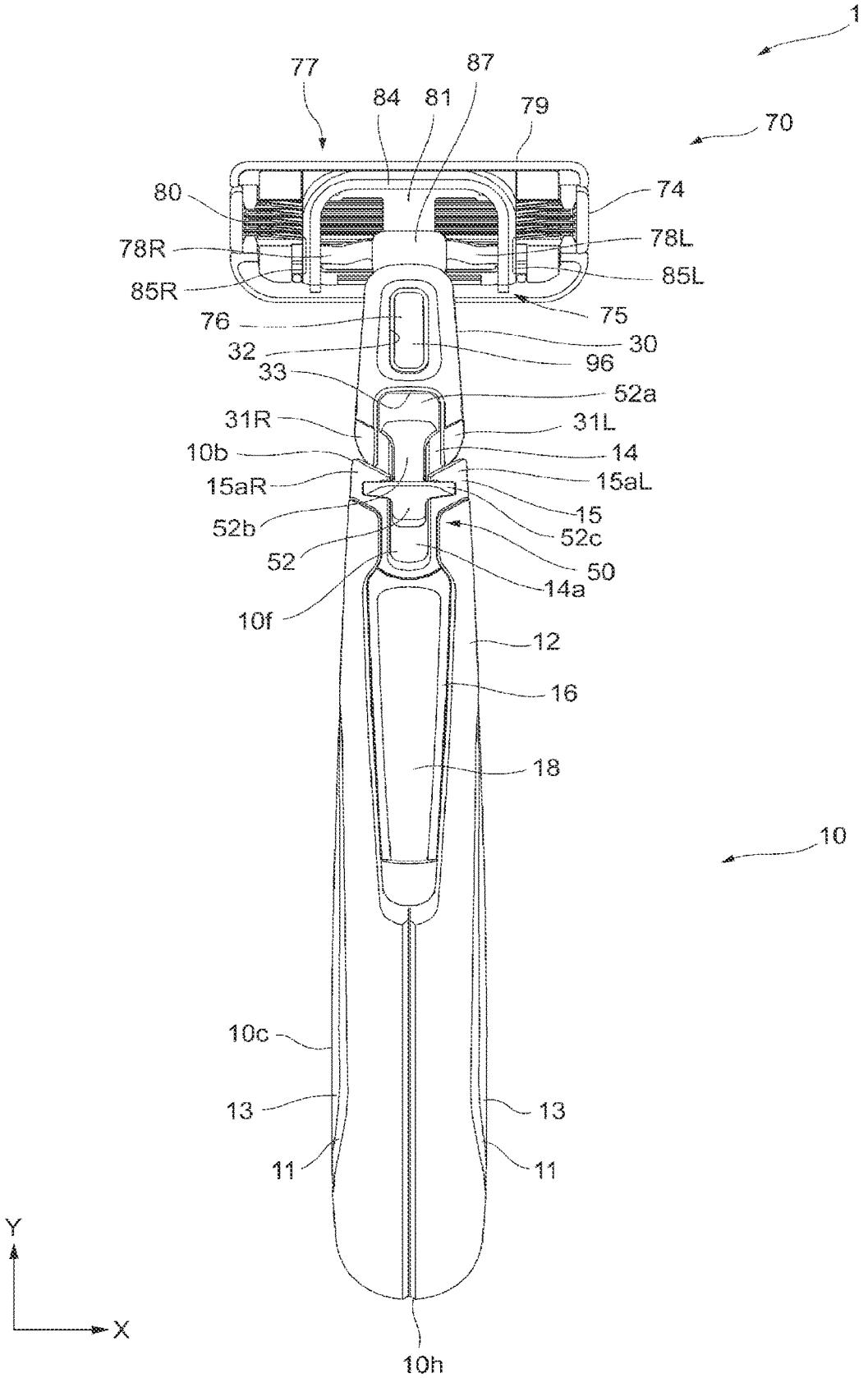
FIG. 4 is a plan view of the handle bending razor in the before-bending state of this embodiment, when viewed from a rear side.
Figure 5:
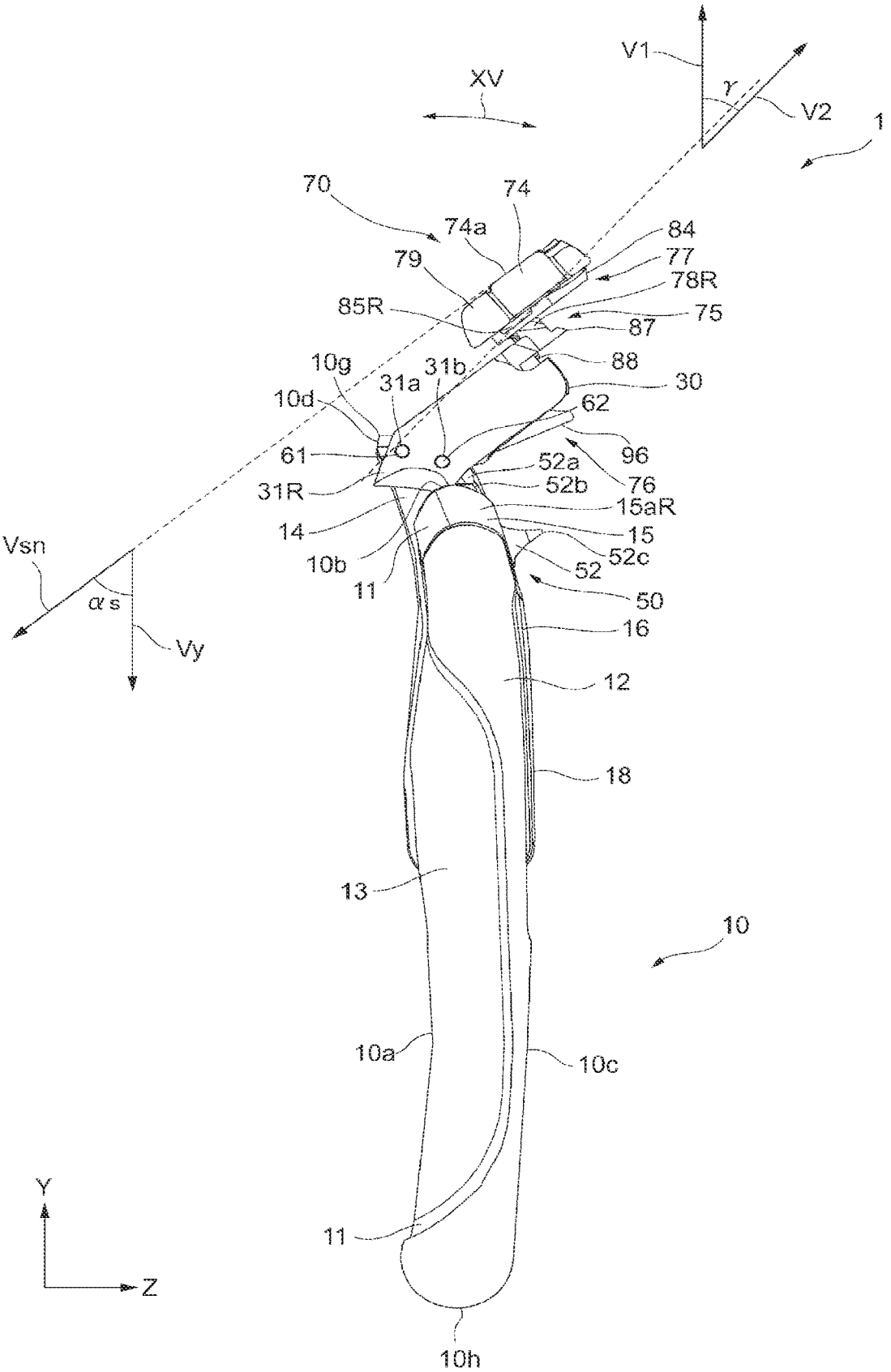
FIG. 5 is a plan view of the handle bending razor in a bent state of this embodiment, when viewed from the right side.
Figure 6:
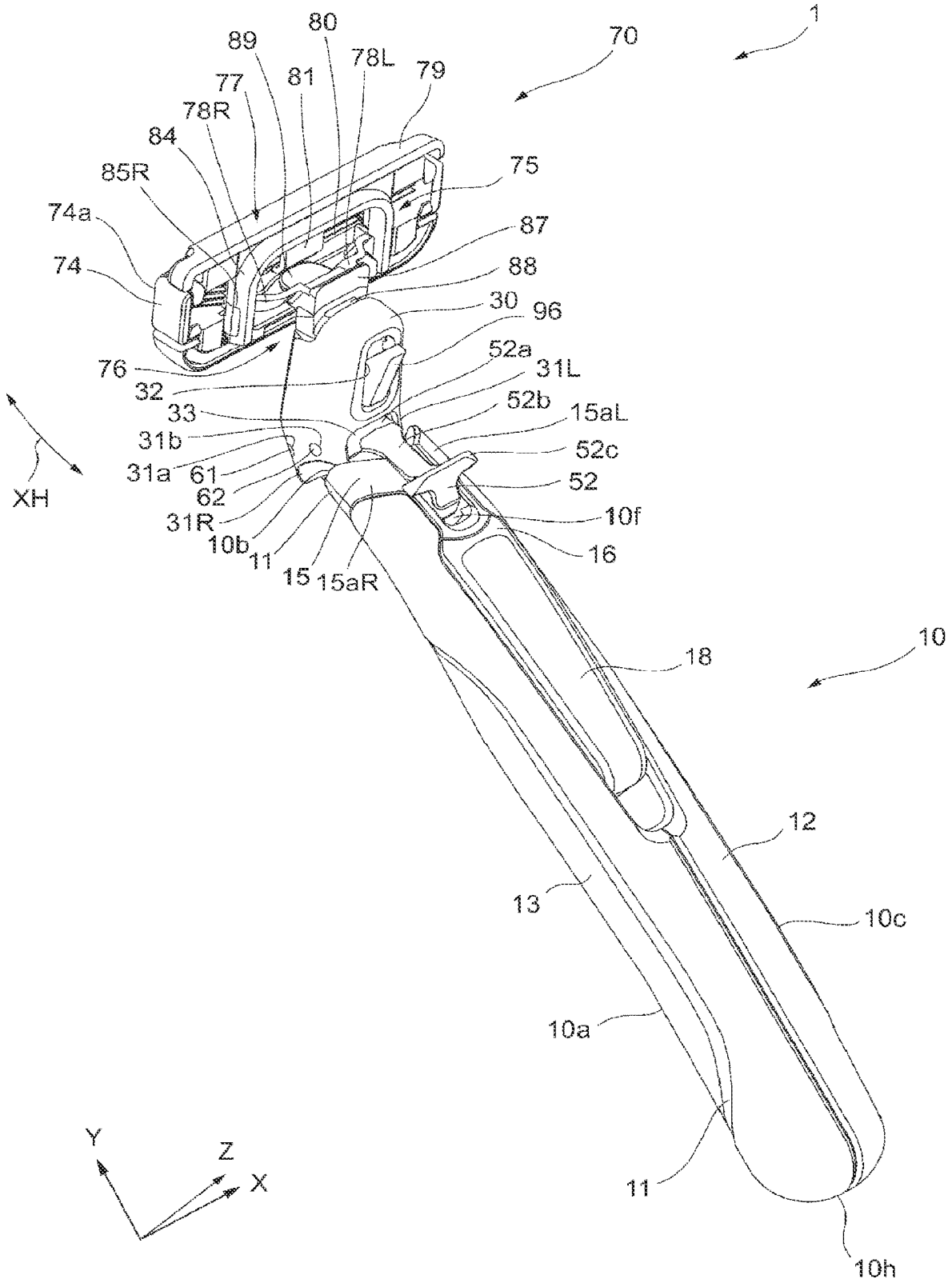
FIG. 6 is a perspective view of the handle bending razor in the bent state of this embodiment, when viewed from the rear right side.
Figure 7:
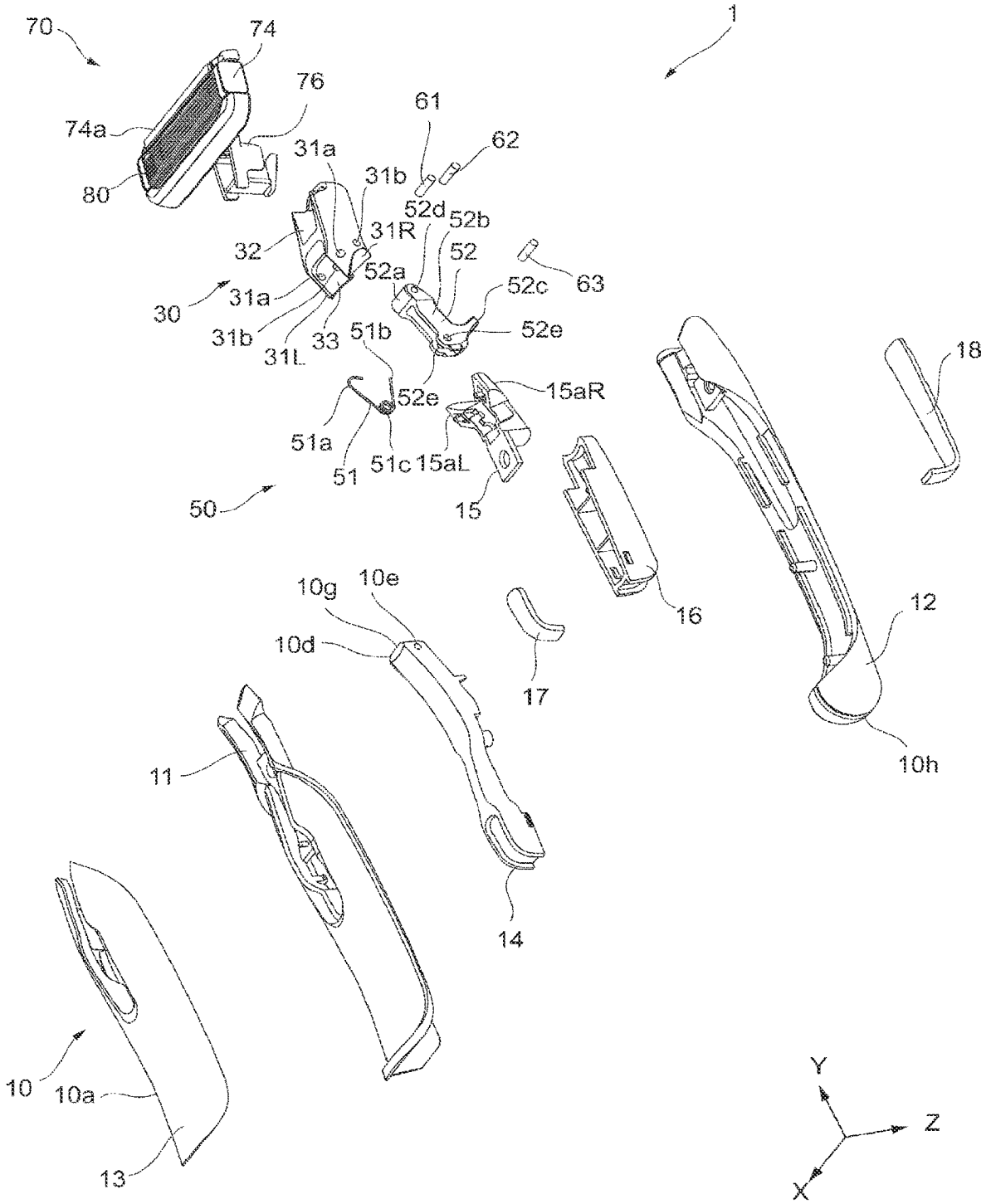
FIG. 7 is an exploded perspective view of the handle bending razor of this embodiment, when viewed from the front right side.
Figure 8:
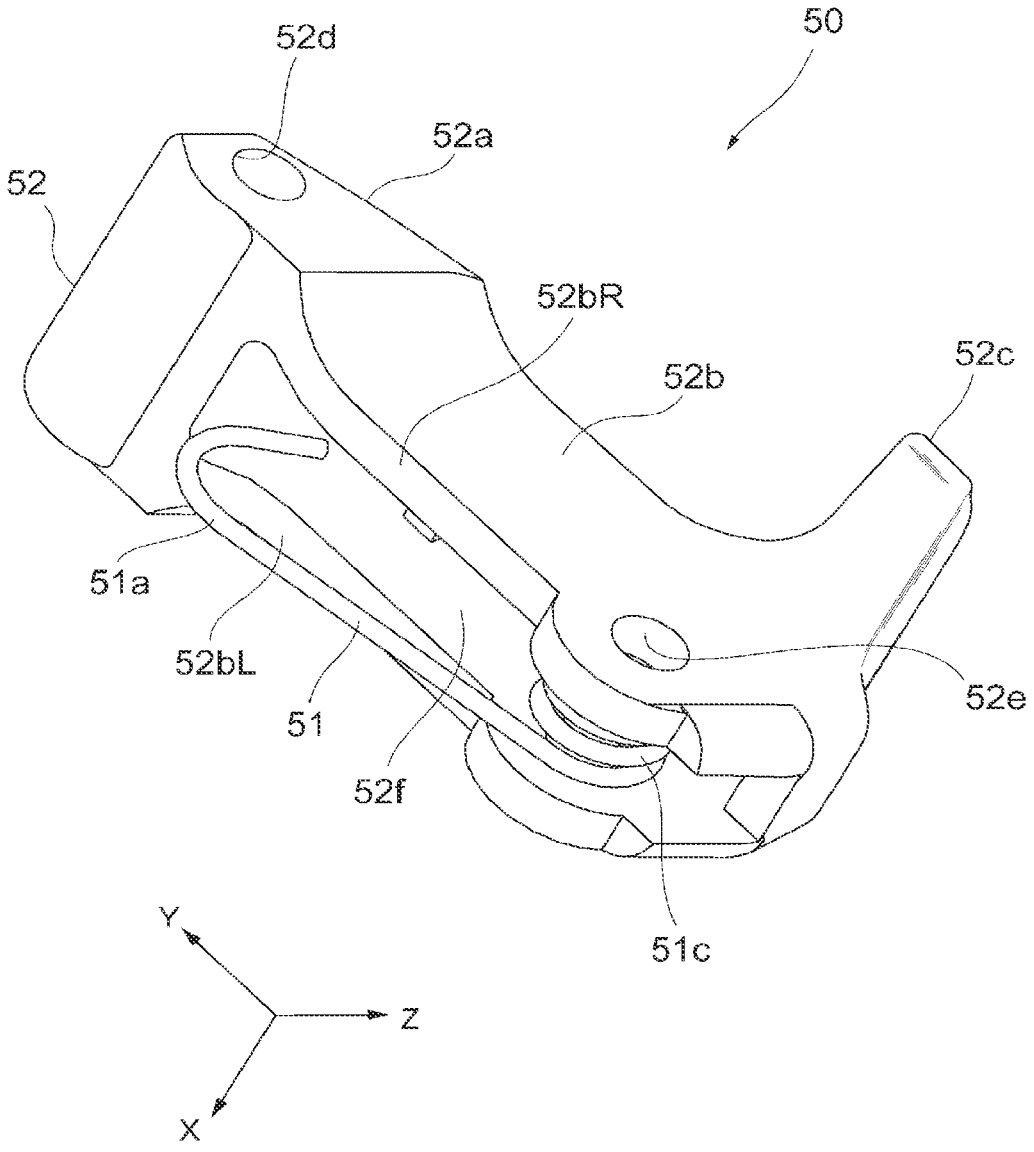
FIG. 8 is a perspective view of a movable body of this embodiment, when viewed from the front right side.
Figure 9:
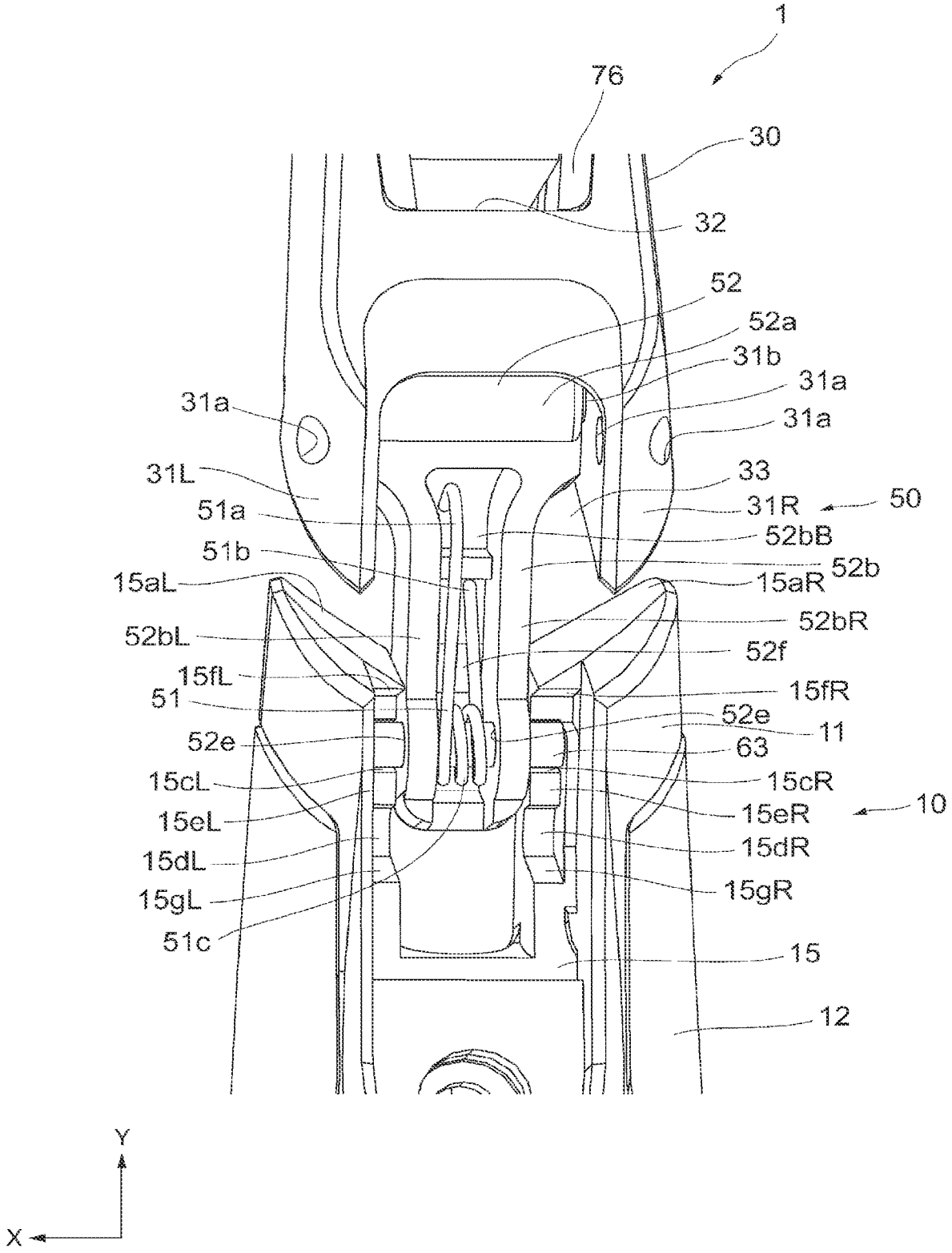
FIG. 9 is an enlarged view of a vicinity of a coupling part between a grip portion and a head coupling portion in the before-bending state of this embodiment, when viewed from the front side.
Figure 10:
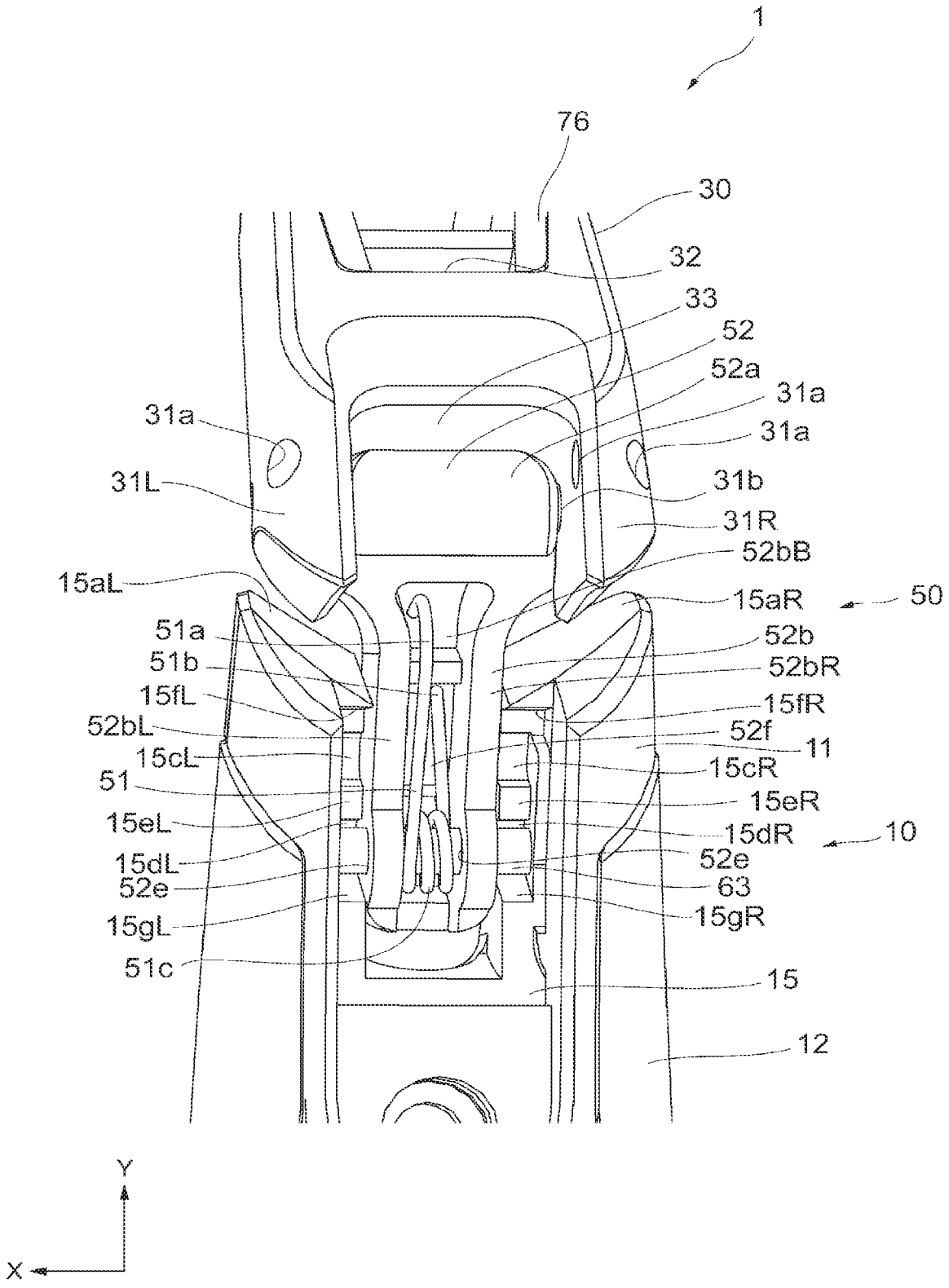
FIG. 10 is an enlarged view of the vicinity of the coupling part between the grip portion and the head coupling portion in the bent state of this embodiment, when viewed from the front side.
Figure 11:
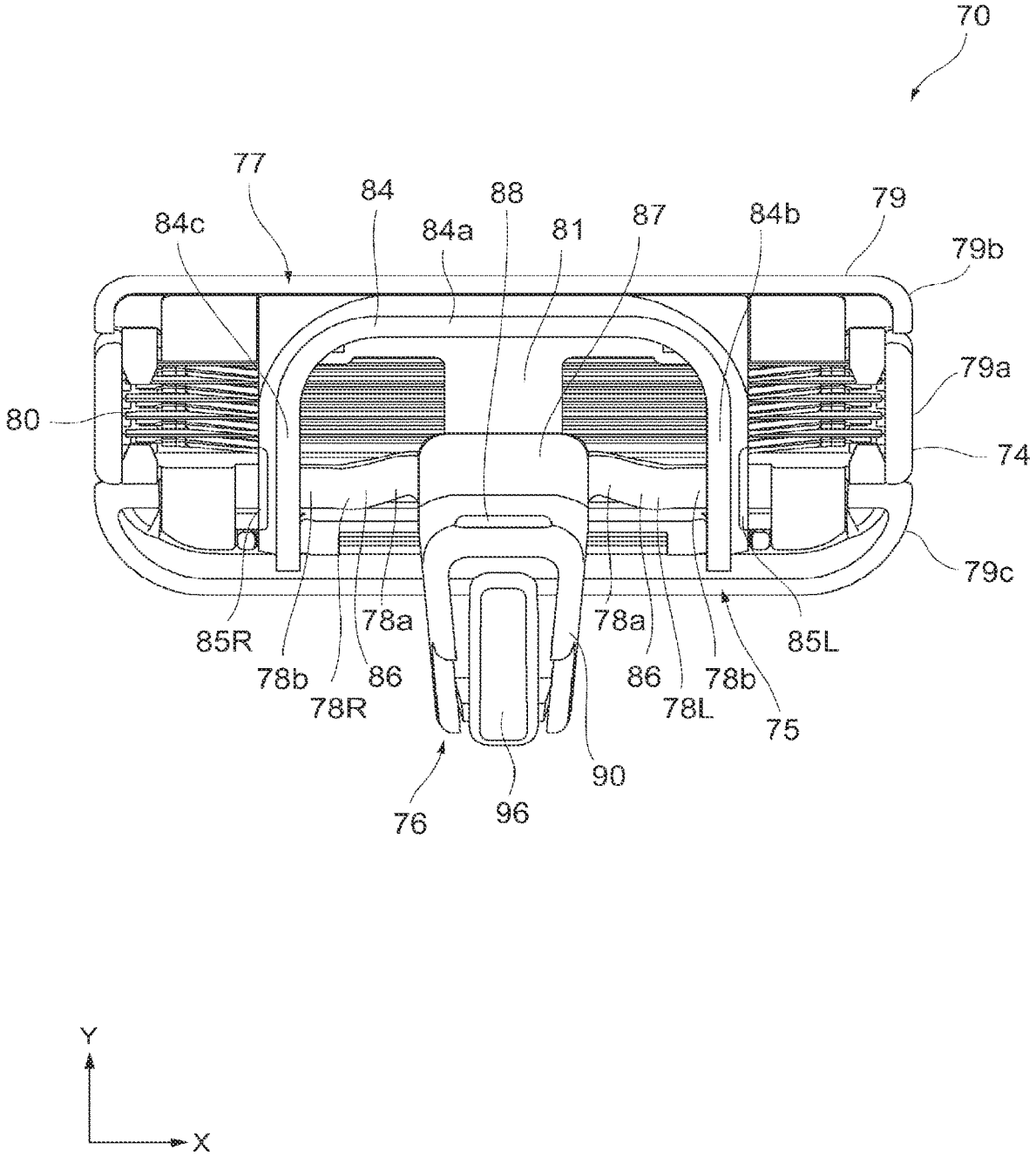
FIG. 11 is a plan view of a razor head of this embodiment, when viewed from the rear side.
Figure 12:
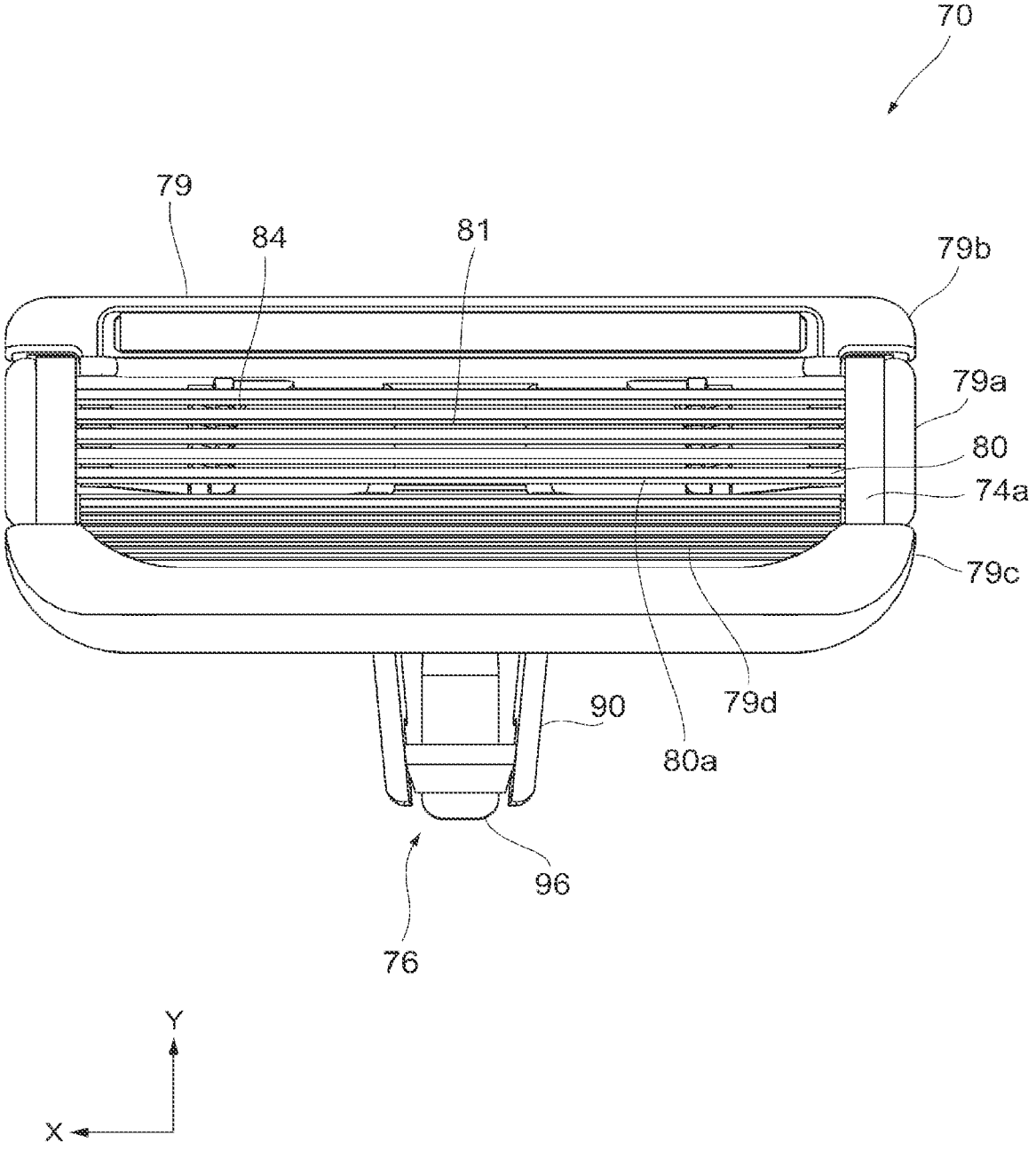
FIG. 12 is a plan view of the razor head of this embodiment, when viewed from the front side.
Figure 13:
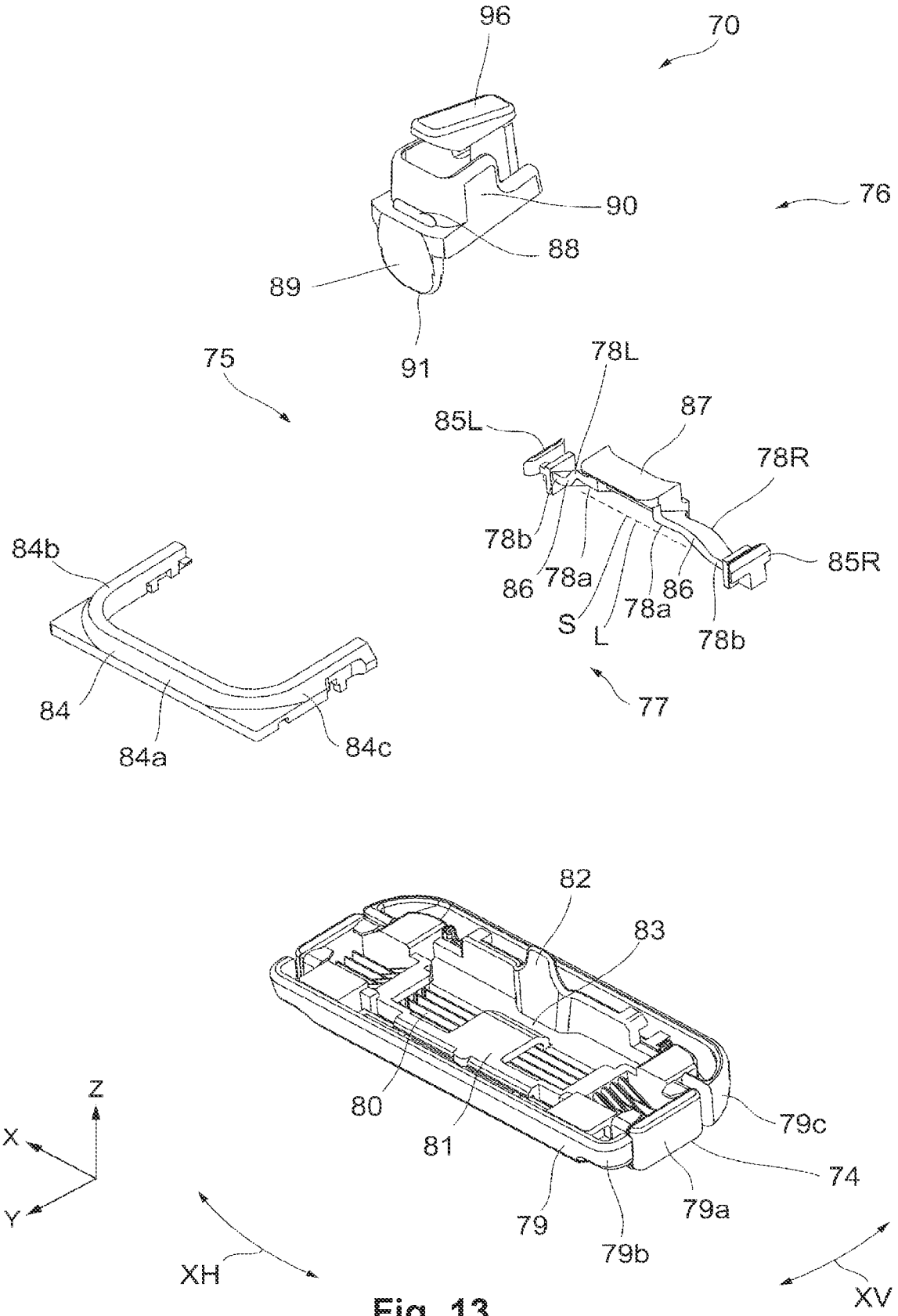
FIG. 13 is an exploded perspective view of the razor head of this embodiment, when viewed from the rear right side.
Figure 14:
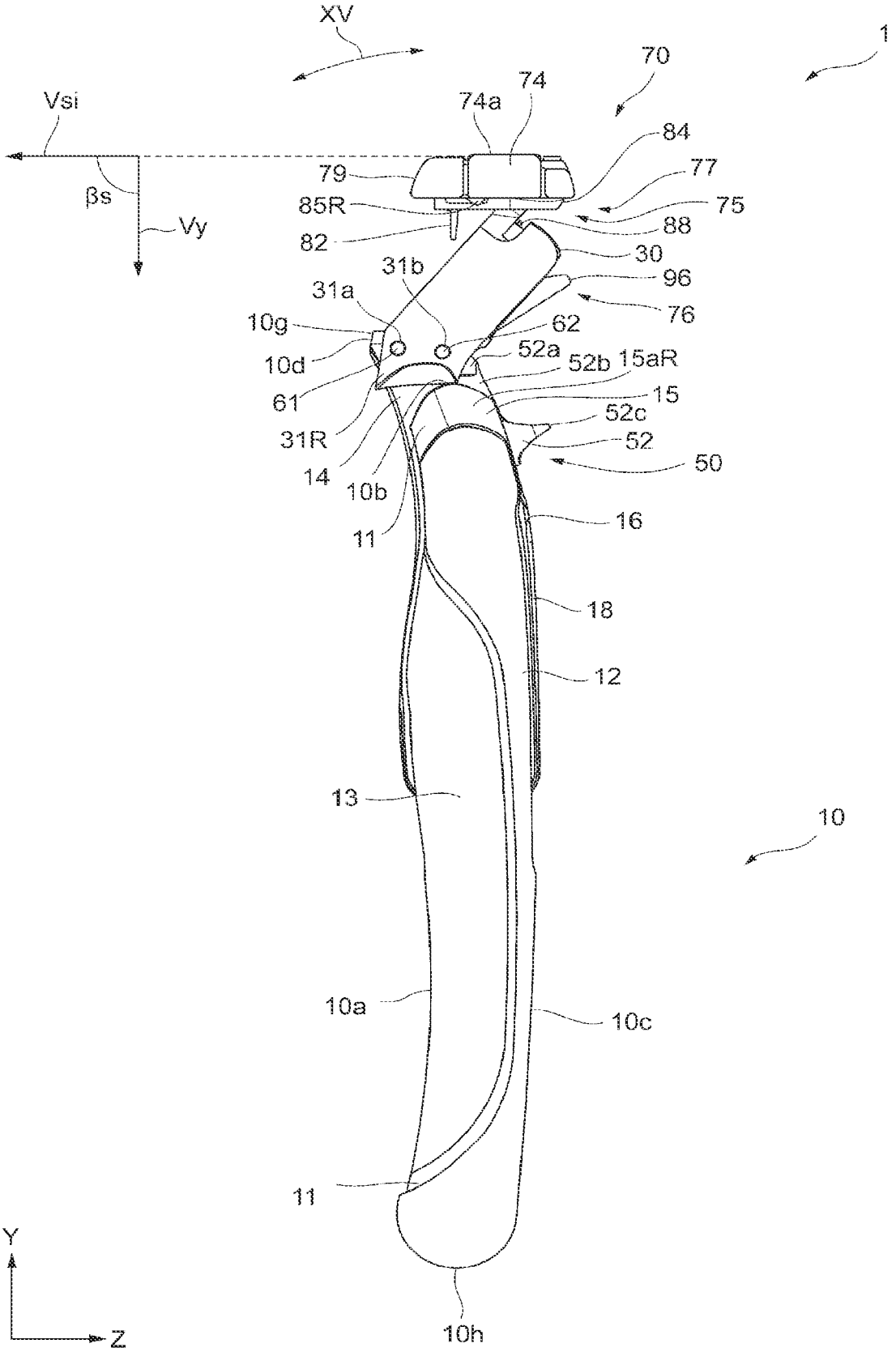
FIG. 14 is a plan view of the handle bending razor when a blade assembly body is at a tilted position in the bent state of this embodiment, when viewed from the right side.

FIG. 1 is a perspective view of a handle bending razor in a before-bending state of this embodiment, when viewed from a rear right side. FIG. 2 is a perspective view of the handle bending razor in the before-bending state of this embodiment, when viewed from a front left side. FIG. 3 is a plan view of the handle bending razor in the before-bending state of this embodiment, when viewed from a right side. FIG. 4 is a plan view of the handle bending razor in the before-bending state of this embodiment, when viewed from a rear side. FIG. 5 is a plan view of the handle bending razor in a bent state of this embodiment, when viewed from the right side. FIG. 6 is a perspective view of the handle bending razor in the bent state of this embodiment, when viewed from the rear right side. FIG. 7 is an exploded perspective view of the handle bending razor of this embodiment, when viewed from the front right side. FIG. 8 is a perspective view of a movable body of this embodiment, when viewed from the front right side. FIG. 9 is an enlarged view of a vicinity of a coupling part between a grip portion and a head coupling portion in the before-bending state of this embodiment, when viewed from the front side. FIG. 10 is an enlarged view of the vicinity of the coupling part between the grip portion and the head coupling portion in the bent state of this embodiment, when viewed from the front side. FIG. 11 is a plan view of a razor head of this embodiment, when viewed from the rear side. FIG. 12 is a plan view of the razor head of this embodiment, when viewed from the front side. FIG. 13 is an exploded perspective view of the razor head of this embodiment, when viewed from the rear right side. FIG. 14 is a plan view of the handle bending razor when a blade assembly body is at a tilted position in the bent state of this embodiment, when viewed from the right side.

In each drawing, an X-axis, a Y-axis, and a Z-axis are shown. An axis directed to a direction in which the grip portion of the handle bending razor extends is defined as the "Y-axis". An axis perpendicular to the Y-axis is defined as the "X-axis". Moreover, an axis perpendicular to both the X-axis and the Y-axis is defined as the "Z-axis". Here, the X-axis, the Y-axis, and the Z-axis form a right-handed system three-dimensional orthogonal coordinates. Hereinafter, an arrow direction of the Z-axis is called the Z-axis+side, and the direction opposite to the arrow is called the Z-axis−side in some cases, and the same applies to the other axes. The X-axis+side and the X-axis−side are called the "left side" and the "right side", respectively, in some cases. The Y-axis+side and the Y-axis−side are called the "upper side" and the "lower side", respectively, in some cases. The Z-axis+side and the Z-axis−side are called the "rear side" and the "front side", respectively, in some cases. The X-axis direction is called the left-right direction in some cases. The Y-axis direction is called the up-down direction in some cases. The Z-axis direction is called the front-back direction in some cases.

<Outline of Configuration>

As shown in FIGS. 1 to 14, the handle bending razor 1 of this embodiment is configured by including a grip portion 10, a head coupling portion 30, a switching mechanism 50, a coupling pin 61 for bending, and a razor head 70. The razor head 70 is configured by including a blade assembly body 74, an elastic support body 75, a connecting portion 76, and a blade body 80. The switching mechanism 50 is configured by including a torsion coil spring 51, a movable body 52, a coupling pin 62 for switching, and a regulating pin 63. Each of the coupling pin 61 for bending, the coupling pin 62 for switching, and the regulating pin is a shaft-shaped member having a columnar shape and is formed by a resin or metal. In FIG. 9 and FIG. 10, the coupling pin 61 for bending and the coupling pin 62 for switching are not shown.

The grip portion 10 is a rod-shaped member extending in parallel to the Y-axis direction and is gripped by the user. The grip portion 10 is also called a "handle" in some cases. The head coupling portion 30 is coupled to an upper end of the grip portion 10, rotatably around the coupling pin 61 for bending which extends substantially in parallel to the X-axis direction. When the switching mechanism 50 is operated by the user, it changes a coupling angle of the grip portion 10 and the head coupling portion 30, and a before-bending state (see FIG. 3) and a bent state (see FIG. 5) are switched. The before-bending state is a specific example of a "first state" referred to in the present invention. The bent state is a specific example of a "second state" referred to in the present invention. The coupling pin 61 for bending is a specific example of a "rotating shaft" referred to in the present invention.

The razor head 70 is coupled to an upper side of the head coupling portion 30. In detail, the connecting portion 76 of the razor head 70 is detachably coupled to the upper side of the head coupling portion 30. The elastic support body 75 is provided between the connecting portion 76 and the bladed assembly body 74. The elastic support body 75 supports the blade assembly body 74 tiltably in the front-back direction and the left-right direction. That is, when an external force is applied, the blade assembly body 74 is tilted at least in either one direction of the front-back direction and the left-right direction. Hereinafter, a position of the blade assembly body 74 when the external force is not applied (see FIG. 3 and FIG. 5) is called a "neutral position" in some cases. Moreover, a position of the blade assembly body 74 tilted when the external force is applied to the blade assembly body 74 is called a "tilted position" in some cases. It is to be noted that the elastic support body 75 may support the blade assembly body 74 tiltably only in the front-back direction.

The blade assembly body 74 has a contact surface 74*a* which is brought into contact with the skin of the user together with the blade body 80 and is faced to the front side. To the blade assembly body 74, the blade body 80 is assembled. The blade body 80 has the left-right direction, that is, the X-axis direction as a longitudinal direction and at least a part thereof exposed to the front side of the razor head 70. A blade edge 80*a* of the blade body 80 is directed diagonally below on the front side.

Here, a vector directed to a direction in which the grip portion 10 extends, that is, a vector in parallel to the Y-axis and directed to the lower side is defined as a "reference vector Vy". A vector in parallel to the direction in which the contact surface 74*a* of the blade assembly body 74 extends and directed to the direction of the blade edge 80*a* is defined as a "target vector". When the blade assembly body 74 is tilted with the grip portion 10 as a reference, the target vector changes its direction with the tilting of the blade assembly body 74. Specifically, in the before-bending state, the target vector when the blade assembly body 74 is located at the neutral position is shown as a target vector Vfn in FIG. 3. In the bent state, the target vector when the blade assembly body 74 is located at the neutral position is shown as a target vector Vsn in FIG. 5. In the bent state, the target vector when the blade assembly body 74 is tilted to the rearmost side is shown as a target vector Vsi in FIG. 14. It is to be noted that, in the bent state, the position of the blade assembly body 74 tilted to the rearmost side is defined as a "maximum tilt position".

The switching mechanism 50 can change an angle formed by the contact surface 74*a* of the blade assembly body 74 and the up-down direction by an operation by the user. In this embodiment, the angle formed by the contact surface 74*a* of the blade assembly body 74 and the up-down direction is defined as an "angle formed by the reference vector Vy and the target vector" (hereinafter, referred to as a "target angle" in some cases.). In the target angles, an angle formed by the reference vector Vy and the target vector when the blade assembly body 74 is located at the neutral position is referred to as a "neutral angle" in some cases. That is, the neutral angle is a target angle when the external force is not applied to the blade assembly body 74. Moreover, among the target angles, an angle formed by the reference vector Vy and the target vector when the blade assembly body 74 is located at the tilt position is referred to as a "tilt angle" in some cases. That is, the tilt angle is a target angle when the external force is applied to the blade assembly body 74, and the blade assembly body 74 is tilted to the rear side. Among the tilt angles, particularly a target angle when the blade assembly body 74 is located at a maximum tilt position is referred to as a "maximum tilt angle" in some cases.

In this embodiment, the neutral angle $\alpha f$ in the before-bending state is approximately 10° (see FIG. 3). The neutral angle $\alpha s$ in the bent state is larger than the neutral angle $\alpha f$ and is substantially 40° (see FIG. 5). That is, when the handle bending razor 1 transits between the before-bending state and the bent state, a coupling angle between the grip portion 10 and the head coupling portion 30 is changed by approximately 30°. It is to be noted that the neutral angle $\alpha f$ in the before-bending state is preferably 10° but may be any angle within a range from 5° or more to 25° or less. Moreover, the neutral angle $\alpha s$ in the bent state is preferably 40° but may be any angle within a range from 25° or more to 60° or less. At this time, by setting a difference ($\alpha s - \alpha f$) between the neutral angle $\alpha s$ and the neutral angle $\alpha f$ to 20° or more to 40° or less, an angle of the contact surface suitable for the forward shaving and the reverse shaving can be obtained easily. The neutral angle $\alpha f$ is a specific example of the "first angle" referred to in the present invention. The neutral angle $\alpha s$ is a specific example of the "second angle" referred to in the present invention.

The target angle when the blade assembly body 74 is at the maximum tilt position, that is, the maximum tilt angle $\beta s$ is approximately 90° (see FIG. 14). It is to be noted that the maximum tilt angle $\beta s$ is preferably 80° or more. Moreover, the maximum tilt angle $\beta s$ is preferably within a range from 80° or more to 120° or less. More preferably, the maximum tilt angle $\beta s$ is within a range from 80° or more to 100° or less.

<Details of Configuration>

<Grip Portion 10>

The grip portion 10 is configured by including a front-side member 11, a rear-side member 12, a non-slip member 13, a protruding member 14, a bifurcated member 15, an internal member 16, and cover members 17 and 18 (see FIG. 7). By coupling the front-side member 11 and the rear-side member 12 to each other, an outer shell having an internal space is formed. The protruding member 14, the bifurcated member 15, the internal member 16, and the cover members 17 and 18 are fixed to the internal space of the outer shell in a state assembled to each other. The non-slip member 13 is formed of an elastomer, for example, and is mounted on the front side of the front-side member 11.

<Protruding portion **10*d***>

The protruding member 14 is a member extending substantially in parallel to the up-down direction. The upper side of the protruding member 14 is a protruding portion **10*d* protruding upward from an upper end of the outer shell. In the protruding portion 10*d*, a through hole 10*e*** extending substantially in parallel to the X-axis id formed.

<Groove **10*f***>

The bifurcated member 15 is coupled to the rear side of the protruding member 14. An upper side of the bifurcated member 15 has a bifurcated shape by a right-side protruding portion **15*a*R and a left-side protruding portion 15*a*L protruding upward being formed. In a space between the right-side protruding portion 15*a*R and the left-side protruding portion 15*a*L, a groove 10*f* in which a surface on the rear side of the protruding member 14 becomes a bottom 14*a* is formed. The groove 10*f* is formed substantially in parallel to the up-down direction, and a part of the movable body 52 is accommodated (see FIG. 4 and FIG. 6**).

A front side on a left side surface of the right-side protruding portion **15*a*R is dug in so as to form an upper-side pin-receiving portion 15*c*R as well as a lower-side pin-receiving portion 15*d*R, a convex portion 15*e*R, and an upper-side contact surface 15*f*R as well as a lower-side contact surface 15*g*R (see FIG. 9 and FIG. 10**).

The upper-side pin-receiving portion **15*c*R has a recessed shape with a front side open and recessed toward a rear side. In the before-bending state, the regulating pin 63 is fitted in the upper-side pin-receiving portion 15*c*R (see FIG. 9). The lower-side pin-receiving portion 15*d*R is located on a lower side of the upper-side pin-receiving portion 15*c*R. The lower-side pin-receiving portion 15*d*R has a recessed shape with a front side open and recessed toward a rear side. In the bent state, the regulating pin 63 is fitted in the lower-side pin-receiving portion 15*d*R (see FIG. 10**).

In a space between the upper-side pin-receiving portion **15*c*R and the lower-side pin receiving portion 15*d*R, the convex portion 15*e*R protruding toward the front side is formed. On an upper side of the upper-side pin-receiving portion 15*c*R, the upper-side contact surface 15*f*R directed downward is formed. On a lower side of the lower-side pin-receiving portion 15*d*R, the lower-side contact surface 15*g***R directed upward is formed.

The left-side protruding portion **15*a*L has a shape symmetric to the right-side protruding portion 15*a*R, and an upper-side pin-receiving portion 15*c*L as well as a lower-side pin-receiving portion 15*d*L, a convex portion 15*e*L, and an upper-side contact surface 15*f*L as well as a lower-side contact surface 15*g*L are formed. The upper-side pin-receiving portion 15*c*L as well as the lower-side pin-receiving portion 15*d*L and the convex portion 15*e*L are formed at positions opposed to the upper-side pin-receiving portion 15*c*R as well as the lower-side pin-receiving portion 15*d*R, and the convex portion 15*e*R, respectively. In the before-bending state, the regulating pin 63 is fitted in the upper-side pin-receiving portion 15*c*L (see FIG. 9). In the bent state, the regulating pin 63 is fitted in the upper-side pin-receiving portion 15*c*R (see FIG. 10**).

The upper-side contact surface **15*f*L and the lower-side contact surface 15*g*L are formed at positions symmetric to the upper-side contact surface 15*f*R and the lower-side contact surface 15*g***R, respectively.

<Recessed Portion **10*a***>

On the grip portion 10, when viewed on a plan view from the left-right direction, a recessed portion **10*a* is formed between an upper end 10*g* and a lower end 10*h* (see FIG. 3). The recessed portion 10*a* is formed on the front side of the grip portion 10 and is recessed to the rear side from substantially a center in the up-down direction of the grip portion 10 to the lower end 10*h***.

<Narrow-width Portion **10*b* and Wide-width Portion 10*c***>

In the grip portion 10, at least a part of an outer periphery between the upper end **10*g* and the lower end 10*h* is smaller than the outer periphery of the lower end 10*h*. In this embodiment, in the vicinity of the upper end 10*g* of the grip portion 10, a narrow-width portion 10*b* whose width in the left-right direction is small when viewed on a plan view from the front-back direction is formed. The grip portion 10 has a width gradually widened from the upper end 10***g* toward the lower end 10*h* when viewed on a plan view from the front-back direction, and in the vicinity of the lower end 10*h* of the grip portion 10, a wide-width portion 10*c* having a width larger than that of the narrow-width portion 10*b* is formed. As described above, by configuring the grip portion 10 having a shape widening from the upper end 10*g* toward the lower end 10*h*, whatever position between the upper end 10*g* and the lower end 10*h* is gripped by the user, when the user applies a downward force, slip of the user's hand on the grip portion 10 can be suppressed.

<Head Coupling Portion 30>

The head coupling portion 30 has a substantially rectangular section and a shape extending substantially in parallel to the up-down direction in the before-bending state. In an upper side of the head coupling portion 30, a through hole 32 extending substantially in parallel to the Z-axis and having a substantially rectangular section is formed. Into the through hole 32, the connecting portion 76 of the razor head 70 is inserted.

On the lower side of the head coupling portion 30, a right-side plate portion 31R and a left-side plate portion 31L protruding toward the lower side are formed, which forms a bifurcated shape. A space between the right-side plate portion 31R and the left-side plate portion 31L is a groove 33 in which the protruding portion 10*d* of the grip portion 10 and the movable body 52 are fitted.

In the vicinity of a lower end of the right-side plate portion 31R, a front-side round hole 31*a* and a rear-side round hole 31*b* extending substantially in parallel to the X-axis are formed. The rear-side round hole 31*b* is located on a rear side above with the front-side round hole 31*a* as a reference in the before-bending state (see FIG. 3).

The left-side plate portion 31L has a shape symmetric to the right-side plate portion 31R. In the left-side plate portion 31L, the front-side round hole 31*a* and the rear-side round hole 31*b* are formed at positions opposed to the front-side round hole 31*a* and the rear-side round hole 31*b* in the right-side plate portion 31R, respectively.

The coupling pin 61 for bending is inserted through the front-side round hole 31*a* of the right-side plate portion 31R, the through hole 10*e* of the protruding portion 10*d*, and the front-side round hole 31*a* of the left-side plate portion 31L. As a result, the head coupling portion 30 is connected to the protruding portion 10*d* of the grip portion 10 rotatably around the coupling pin 61 for bending.

<Switching Mechanism 50>

As described above, the switching mechanism 50 is configured by including the torsion coil spring 51, the movable body 52, the coupling pin 62 for switching, and the regulating pin 63.

<Movable Body 52>

<Wide-width Portion 52*a*>

The movable body 52 is configured by including a wide-width portion 52*a*, a narrow-width portion 52*b*, and an operation portion 52*c* and is disposed on the rear side of the protruding portion 10*d*. In this embodiment, the wide-width portion 52*a*, the narrow-width portion 52*b*, and the operation portion 52*c* are integrally formed. The wide-width portion 52*a* is fitted in the groove 33 of the head coupling portion 30 and is rotatably coupled to the head coupling portion 30. In detail, in the wide-width portion 52*a*, a through round hole 52*d* extending substantially in parallel to the X-axis and into which the coupling pin 62 for switching is inserted is formed. The coupling pin 62 for switching is inserted into the rear-side round hole 31*b* of the right-side plate portion 31R, the through round hole 52*d* of the movable body 52, and the rear-side round hole 31*b* of the left-side plate portion 31L. As a result, the movable body 52 is connected to the head coupling portion 30 rotatably around the coupling pin 62 for switching.

<Narrow-width Portion 52*b*>

The narrow-width portion 52*b* has a width smaller than the width in the left-right direction of the wide-width portion 52*a* and is fitted in the groove 10*f* of the grip portion 10. In detail, the narrow-width portion 52*b* is configured by including a right-side plate portion 52*b*R and a left-side plate portion 52*b*L and a bottom plate portion 52*b*B.

The right-side plate portion 52*b*R and the left-side plate portion 52*b*L extend from the rear side of the wide-width portion 52*a* toward the lower side while opposing each other. The left-side plate portion 52*b*L has a shape symmetric to the right-side plate portion 52*b*R. Since the bottom plate portion 52*b*B is formed between the rear side of the right-side plate portion 52*b*R and the rear side of the left-side plate portion 52*b*L, a groove 52*f* in which the bottom plate portion 52*b*B becomes the bottom is formed. On the right side of the right-side plate portion 52*b*R, the right-side protruding portion 15*a*R of the grip portion 10 is located. On the left side of the left-side plate portion 52*b*L, the left-side protruding portion 15*a*L of the grip portion 10 is located.

In the lower side of the right-side plate portion 52*b*R, a through round hole 52*e* extending substantially in parallel to the X-axis and into which the regulating pin 63 is inserted is formed. In the left-side plate portion 52*b*L, the through round hole 52*e* into which the regulating pin 63 is inserted is formed at a position opposed to the through round hole 52*e* of the right-side plate portion 52*b*R.

<Operation Portion 52*c*>

The operation portion 52*c* has a width larger than the width in the left-right direction of the groove 10 of the grip portion 10, and is disposed on the rear side of the narrow-width portion 52*b*. The operation portion 52*c* is exposed to the outer side of the grip portion 10 so that the user can operate it easily. In this embodiment, the operation portion 52*c* protrudes to the outer side of the groove 10*f* of the grip portion 10, that is, the rear side of the grip portion 10. The user can push the movable body 52 into the front side or move the movable body 52 in the up-down direction by operating the operation portion 52*c*.

<Torsion Coil Spring 51 and Regulating Pin 63>

The torsion coil spring 51 is configured by including a front-side contact portion 51*a*, a rear-side contact portion 51*b*, and a coil portion 51*c*. The rear-side contact portion 51*b* is brought into contact with the bottom plate portion 52*b*B of the movable body 52, that is, the bottom of the groove 52*f*. The front-side contact portion 51*a* is brought into contact with the bottom 14*a* of the groove 10*f* of the grip portion 10. The coil portion 51*c* is disposed inside the groove 52*f* of the movable body 52, between the through round hole 52*e* of the right-side plate portion 52*b*R and the through round hole 52*e* of the left-side plate portion 52*b*L.

The regulating pin 63 is inserted into the through round hole 52*e* of the right-side plate portion 52*b*R, the coil portion 51*c* of the torsion spring 51, and the through round hole 52*e* of the left-side plate portion 52*b*L. As a result, the coil portion 51*c* is rotatable on a YZ plane with the regulating pin 63 as a rotating shaft.

The torsion coil spring 51 is disposed between the bottom of the groove 52*f* of the movable body 52 and the bottom 14*a* of the groove 10*f* of the grip portion 10 in a compressed state. That is, the torsion coil spring 51 urges the movable body 52 to the rear side and urges the grip portion 10 to the front side.

<Switching between Before-bending State and Bent State>

The user can switch between the before-bending state (see FIG. 3) and the bent state (see FIG. 5) of the handle bending razor 1 by operating the operation portion 52*c* of the movable body 52. Specifically, the movable body 52 moves between a before-bending position (see FIG. 3 and FIG. 9) where the before-bending state of the handle bending razor 1 is maintained and a bent position (see FIG. 5 and FIG. 10) where the bent state of the handle bending razor 1 is maintained. When the movable body 52 is located at the before-bending position, the movement from the before-bending position to the bent position is regulated, and when it is located at the bent position, the movement from the bent position to the before-bending position is regulated. It is to be noted that the before-bending position is a specific example of the "first position" referred to in the present invention. The bent position is a specific example of the "second position" referred to in the present invention.

The regulation on the movement of the movable body 52 from the before-bending position to the bent position and the regulation on the movement of the movable body 52 from the bent position to the before-bending position are released by pressing-down on the operation portion 52*c* to the front side by the user.

In the before-bending state, a coupled vector V1 (see FIG. 3 and FIG. 5) directed to the first direction from the rotating shaft parallel to the X-axis direction toward the elastic support body 75 is substantially parallel to the extending direction of the grip portion 10, that is, the Y-axis. In the bent state, a coupled vector V2 (see FIG. 5) directed to the second direction from the rotating shaft toward the elastic support body 75 is directed to the rear side, which is a side opposite to the front side where the blade edge 80*a* of the blade body 80 in the first state can be exposed, as compared with the first direction. Thus, in the before-bending state, since the grip portion 10 and the head coupling portion 30 can be configured to integrally extend in the up-down direction, the handle bending razor 1 can have a simple shape similar to a general razor, and the handle bending razor can be used with a sense of use equal to that of the general razor. Moreover, in the bent state, the blade assembly body can be located on the rear side from an extension line on the upper side of the grip portion 10 so as to be suitable for the forward shaving and the reverse shaving under the chin and the reverse shaving of the cheek. It is to be noted that an angle $\gamma$ formed by the coupled vector V1 and the coupled vector V2 (see FIG. 5) becomes equal to the difference ($\alpha s-\alpha f$) between the neutral angle $\alpha f$ and the neutral angle $\alpha s$.

<Before-bending State>

When the movable body 52 is located at the before-bending position, a right end and a left end of the regulating pin 63 are fitted in the upper-side pin-receiving portion 15*c*R and the upper-side pin-receiving portion 15*c*L, respectively (see FIG. 9).

At this time, since the movable body 52 is urged to the rear side by the torsion coil spring 51, the regulating pin 63 is urged to the rear side through a contact portion with the movable body 52, that is, through the through round hole 52*e* of the movable body 52. That is, the right end and the left end of the regulating pin 63 are pressed onto the upper-side pin-receiving portions 15*c*R and 15*c*L, respectively.

Thus, even when the external force to move the movable body 52 to the upper side or the lower side is applied to the movable body 52, the movement in the up-down direction of the regulating pin 63 is regulated by the upper-side pin-receiving portions 15*c*R and 15*c*L and thus, the movement in the up-down direction of the movable body 52 with respect to the grip portion 10 is also regulated. That is, the movable body 52 is fixed to the before-bending position.

The head coupling portion 30 is coupled to the grip portion 10 rotatably around the coupling pin 61 for bending and is also coupled to the movable body 52 rotatably around the coupling pin 62 for switching. Since the movable body 52 is fixed at the before-bending position, rotation of the head coupling portion 30 around the coupling pin 61 for bending is also regulated. That is, even when the external force to cause the head coupling portion 30 to fall down to the front side or the rear side is applied to the head coupling portion 30, the coupling angle between the grip portion 10 and the head coupling portion 30 is maintained. That is, the before-bending state of the handle bending razor 1 is maintained.

<Movement from Before-Bending Position to Bent Position>

When the user applies the external force to push into the front side to the operation portion 52*c* against the urging of the torsion coil spring 51, the torsion coil spring 51 is compressed, and the movable body 52 and the regulating pin 63 move to the front side. When a pushing-in amount of the operation portion 52*c* by the user exceeds a predetermined value, the right end and the left end of the regulating pin 63 are brought into a state removed from the upper-side pin-receiving portions 15*c*R and 15*c*L, respectively. When the user applies the external force to the operation portion 52*c* to move the operation portion 52*c* to the lower side in a state where the operation portion 52*c* is pushed in, the movable body 52 moves to the lower side together with the torsion coil spring 51 and the regulating pin 63.

The head coupling portion 30 is coupled to the movable body 52 through the coupling pin 62 for switching and thus, it receives a rotary force in a direction to fall down to the rear side from the movable body 52 with the coupling pin 61 for bending as a rotation center. As a result, the head coupling portion 30 falls down to the rear side in accordance with a movement amount of the movable body 52 to the lower side.

<Bent State>

When the user, for example, moves the movable body 52 to the lower side until the right end and the left end of the regulating pin 63 and the lower-side contact surfaces 15*g*R and 15*g*L are brought into contact, respectively, and then, weakens the force to push in the operation portion 52*c* to the front side, the movable body 52 and the regulating pin 63 move to the rear side by the urging of the torsion coil spring 51. By means of this movement, the right end and the left end of the regulating pin 63 are brought into contact with a lower-side inclined surface of the lower-side pin-receiving portion 15*d*R and a lower-side inclined surface of the lower-side pin-receiving portion 15*d*L, respectively. Then, the right end and the left end of the regulating pin 63 move to the rear side along these lower-side inclined surfaces and are brought into a state fitted in the lower-side pin-receiving portions 15*d*R and 15*d*L, respectively (see FIG. 10).

At this time, since the movable body 52 is urged to the rear side by the torsion coil spring 51, the regulating pin 63 is urged to the rear side through the contact portion with the movable body 52, that is, through the through round hole 52*e* of the movable body 52. That is, the right end and the left end of the regulating pin 63 are pressed onto the lower-side pin-receiving portions 15*d*R and 15*d*L, respectively.

Thus, even if the external force to move the movable body 52 to the upper side or the lower side is applied to the movable body 52, the movement in the up-down direction of the regulating pin 63 is regulated by the lower-side pin-receiving portions 15*d*R and 15*d*L and thus, the movement in the up-down direction of the movable body 52 with respect to the grip portion 10 is also regulated. That is, the movable body 52 is fixed at the bent position.

Since the movable body 52 is fixed at the bent position, rotation of the head coupling portion 30 around the coupling pin 61 for bending is also regulated. That is, even if the external force to cause the head coupling portion 30 to fall down to the front side or the rear side is applied to the head coupling portion 30, the coupling angle between the grip portion 10 and the head coupling portion 30 is maintained. That is, the bent state of the handle bending razor 1 is maintained.

It is to be noted that the user can switch the before-bending state to the bent state without moving the movable body 52 to the lower side until the right end and the left end of the regulating pin 63 are brought into contact with the lower-side contact surfaces 15*g*R and 15*g*L, respectively. Specifically, when the user moves the regulating pin 63 until it goes over the convex portions 15*e*R and 15*e*L to the lower side and then, weakens the force to push in the operation portion 52*c* to the front side, for example, the right end of the regulating pin 63 is brought into contact with either one of the upper-side inclined surface and the lower-side inclined surface of the lower-side pin-receiving portion 15*d*R by the urging of the torsion coil spring 51. Similarly, the left end of the regulating pin 63 is also brought into contact with either one of the upper-side inclined surface and the lower-side inclined surface of the lower-side pin-receiving portion 15*d*L. Then, the right end and the left end of the regulating pin 63 move to the rear side along these inclined surfaces and are brought into a state fitted in the lower-side pin-receiving portions 15*d*R and 15*d*L, respectively.

<Movement from Bent Position to Before-bending Position>

In a state where the movable body 52 is located at the bent position (see FIG. 10), when the user applies the external force to push-in to the front side to the operation portion 52*c* against the urging of the torsion coil spring 51, the torsion coil spring 51 is compressed, and the movable body 52 and the regulating pin 63 move to the front side. When the pushing-in amount of the operation portion 52*c* by the user exceeds a predetermined value, the right end and the left end of the regulating pin 63 are brought into a state of being removed from the lower-side pin-receiving portions 15*d*R and 15*d*L, respectively. When the user applies the external force to move the operation portion 52*c* to the upper side to the operation portion 52*c* in the state where the operation portion 52*c* is pushed in, the movable body 52 moves to the upper side together with the torsion coil spring 51 and the regulating pin 63.

Since the head coupling portion 30 is coupled to the movable body 52 through the coupling pin 62 for switching, a rotary force in a direction to rise to the front side with the coupling pin 61 for bending as a rotation center is received from the movable body 52. As a result, the head coupling portion 30 rises to the front side in accordance with a moving amount to the front side of the movable body 52.

If the user weakens the force to push in the operation portion 52*c* to the front side, after moving the movable body 52 to the upper side until the right end and the left end of the regulating pin 63 and the upper-side contact surfaces 15*f*R and 15*f*L are brought into contact, respectively, for example, the movable body 52 and the regulating pin 63 move to the rear side by the urging of the torsion coil spring 51. By means of this movement, the right end and the left end of the regulating pin 63 are brought into contact with the lower-side inclined surface of the upper-side pin-receiving portion 15*c*R and the lower-side inclined surface of the upper-side pin-receiving portion 15*c*L, respectively. Then, the right end and the left end of the regulating pin 63 move to the rear side along these lower-side inclined surfaces and are brought into a state fitted in the upper-side pin-receiving portions 15*c*R and 15*c*L, respectively (see FIG. 9).

It is to be noted that the user can switch the bent state to the before-bending state without moving the movable body 52 to the upper side until the right end and the left end of the regulating pin 63 are brought into contact with the upper-side contact surfaces 15*f*R and 15*f*L, respectively. Specifically, when the user moves the regulating pin 63 until it goes over the convex portions 15*e*R and 15*e*L to the upper side and then, weakens the force to push in the operation portion 52*c* to the front side, for example, the right end of the regulating pin 63 is brought into contact with either one of the upper-side inclined surface and the lower-side inclined surface of the upper-side pin-receiving portion 15*c*R by the urging of the torsion coil spring 51. Similarly, the left end of the regulating pin 63 is also brought into contact with either one of the upper-side inclined surface and the lower-side inclined surface of the upper-side pin-receiving portion 15*c*L. Then, the right end and the left end of the regulating pin 63 move to the rear side along these inclined surfaces and are brought into a state fitted in the upper-side pin-receiving portions 15*c*R and 15*c*L, respectively.

<Razor Head 70>

As described above, the razor head 70 is configured by including the blade assembly body 74, the elastic support body 75, the connecting portion 76, and the blade body 80 (see FIGS. 11 to 13).

The blade assembly body 74 is configured by including a frame portion 79. The frame portion 79 has an intermediate part 79*a*, an upper part 79*b*, and a lower part 79*c*. In the frame portion 79, the upper part 79*b* and the lower part 79*c* are locked by the intermediate part 79*a* and mounted, unable to be removed. In the intermediate part 79*a*, a plurality of blade bodies 80 are assembled and aligned in the up-down direction. The blade edge 80*a* of each of the blade bodies 80 is extended and provided in the left-right direction by being exposed to the front side of the intermediate part 79*a*. In the frame portion 79, an irregular-state loading table portion 81 is formed on the rear side of the intermediate part 79*a*. On the lower side of the loading table portion 81 and at a center in the left-right direction, a plate-shaped regulating portion 82 protruding toward the rear side is formed. Between a base part of the regulating portion 82 and the loading table portion 81, a fulcrum groove portion 83 is extended and provided in the left-right direction. The front side of the frame portion 79, that is, a surface on a front surface side is a contact surface 74*a* brought into contact with the skin of the user together with the blade body 80. On the upper part 79*b* of the frame portion 79 and the contact surface 74*a* of the lower part 79*c*, a shaving aid is mounted. Particularly on the contact surface 74*a* of the lower part 79*c*, a fin 79*d* made of a soft resin is provided so that the beard can be raised (see FIG. 12).

The elastic support body 75 is configured by including a support portion 77, a left-side flexible portion 78L and a right-side flexible portion 78R. The support portion 77 is configured by including a loading portion 84, a left-side continuing portion 85L and a right-side continuing portion 85R. Hereinafter, each of the left-side flexible portion 78L and the right-side flexible portion 78R is referred to simply as the flexible portion 78 in some cases. Hereinafter, each of the left-side continuing portion 85L and the right-side continuing portion 85R is referred to simply as the continuing portion 85 in some cases.

The loading portion 84 is formed having a U-shape by an upper part 84*a*, a left part 84*b*, and a right part 84*c*. The loading portion 84 is locked by the loading table portion 81 of the blade assembly body 74 and mounted, unable to be removed. The connecting portion 76 is disposed between the left part 84*b* and the right part 84*c* of the loading portion 84.

The left-side flexible portion 78L is extended between the connecting portion 76 and the left part 84*b*. The right-side flexible portion 78R has a symmetric shape to the left-side flexible portion 78L and is extended between the connecting portion 76 and the right part 84*c*. The left-side continuing portion 85L and the right-side continuing portion 85R are integrally molded with the left-side flexible portion 78L and the right-side flexible portion 78R, respectively. The left-side continuing portion 85L and the right-side continuing portion 85R are disposed on the left part 84*b* and the right part 84*c*, respectively.

The flexible portion 78 has a plate shape with a rectangular section and has an inner end portion 78*a* adjacent to the connecting portion 76, an outer end portion 78*b* adjacent to the left part 84*b* or the right part 84*c* of the support portion 77, and an inclined portion 86. Here, an area of a space connecting the outer end portion 78*b* of the left-side flexible portion 78L and the outer end portion 78*b* of the right-side flexible portion 78R is defined as an "assumed airspace S" (see FIG. 13). The inclined portion 86 is inclined so as to approach the assumed airspace S as it goes from the inner end portion 78*a* toward the outer end portion 78*b*.

Here, the assumed airspace S means a cylindrical space area on an assumed line L connecting the outer end portions 78*b* of the both flexible portions 78 to each other or surrounding an outer periphery of the assumed line L. In other words, it is a cylindrical airspace including an extension line of an outer peripheral edge of the outer end portion 78*b* having a predetermined sectional shape such as a rectangle shape. An interval between the inclined portion 86 of the left-side flexible portion 78L and the inclined portion 86 of the right-side flexible portion 78R gradually becomes larger as it goes from the inner end portion 78*a* toward the outer end portion 78*b*. The inclined portion 86 is inclined with respect to the assumed airspace S when viewed from both the front-back direction and the up-down direction.

The connecting portion 76 is configured by including a continuing portion 87, a main body portion 88, a tongue piece portion 89, and a coupling cylinder portion 90. The continuing portion 87 is located between the inner end portion 78*a* of the left-side flexible portion 78L and the inner end portion 78*a* of the right-side flexible portion 78R and is integrally molded with the left-side flexible portion 78L and the right-side flexible portion 78R.

On the main body portion 88, the continuing portion 87 is provided on the upper side thereof and is faced with the regulating portion 82 of the blade assembly body 74 above it. The tongue piece portion 89 has a plate shape extended and provided from the main body portion 88 toward the front side. The coupling cylinder portion 90 is extended and provided from the main body portion 88 toward the rear side. A thickness in the up-down direction of the tongue piece portion 89 is set smaller than a width in the left-right direction and a length in the front-back direction. The length in the front-back direction is smaller than the width in the left-right direction.

On a free end part of the tongue piece portion 89, a fulcrum edge portion 91 is extended and provided in the left-right direction and is brought into contact with the fulcrum groove portion 83 of the blade assembly body 74. On the fulcrum edge portion 91, a thickness between an upper surface and a lower surface becomes smaller as the upper surface is inclined and goes toward the free end part side. The fulcrum groove portion 83 of the blade assembly body 74 and the fulcrum edge portion 91 of the tongue piece portion 89 are disposed on a side lower than the blade edge 80*a* of the blade body 80 and on an inner side of the assumed airspace S. In the razor head 2, the blade assembly body 74 and the support portion 77 of the elastic support body 75 are supported by contact between the fulcrum groove portion 83 and the fulcrum edge portion 91.

The blade assembly body 74 can take movement positions in a moving direction XV, capable of moving in an arc shape from the neutral position to the front-back direction on the YZ plane including the front-back direction and the up-down direction with deformation of the flexible portion 78 (see FIGS. 3, 5, 13, and 14). In this embodiment, when the handle bending razor 1 is in the before-bending state, the blade assembly body 74 is tiltable in the front-back direction within a range of the target angle from 10° or more to 60° or less. Moreover, when the handle bending razor 1 is in the bent state, the blade assembly body 74 is tiltable in the front-back direction within a range of the target angle from 40° or more to 90° or less. It is to be noted that, in the aforementioned example, the tiltable range of the blade assembly body 74 is from 50°, but the tiltable range may be changed arbitrarily. Specifically, it may be configured that the tiltable range of the blade assembly body 74 is any angle within a range from 20° or more to 70° or less.

Moreover, with deformation of the flexible portion 78, the blade assembly body 74 can take a movement position in a moving direction XH, capable of moving in the arc shape from the neutral position to the front-back direction on a ZX plane including the left-right direction and the front-back direction (see FIGS. 6 and 13). The fulcrum groove portion 83 of the blade assembly body 74 and the fulcrum edge portion 91 of the tongue piece portion 89 are formed having an arc shape along the moving direction XV, capable of moving in the arc shape in the front-back direction on the YZ plane. The fulcrum edge portion 91 of the tongue piece portion 89 is formed having an arc shape along the moving direction XH, capable of moving in the arc shape in the front-back direction on the ZX plane.

In the razor head 70, the support portion 77 of the elastic support body 75 and the connecting portion 76 are molded at the same time in one die excluding their continuing portions 85 and 87. The flexible portion 78 is molded with these continuing portions 85 and 87. And the support portion 77 and the connecting portion 76 are integrally formed by being connected to each other by these continuing portions 85 and 87.

Regarding coupling between the razor head 70 and the head coupling portion 30, an elastic lock/release portion 96 is extended and provided toward the rear side in the coupling cylinder portion 90 of the connecting portion 76. In the through hole 32 of the head coupling portion 30, the coupling cylinder portion 90 is inserted and detachably attached by engagement by the elastic lock/release portion 96. In this inserted/attached state, the head coupling portion 30 and the connecting portion 76 integrally continue to each other. By releasing the engagement by the elastic lock/release portion 96 and by pulling out the coupling cylinder portion 90 from the through hole 32, the head coupling portion 30 and the connecting portion 76 can be separated from each other.

<First Use Mode: Forward Shaving under the Chin in Bent State>

Figure 15:
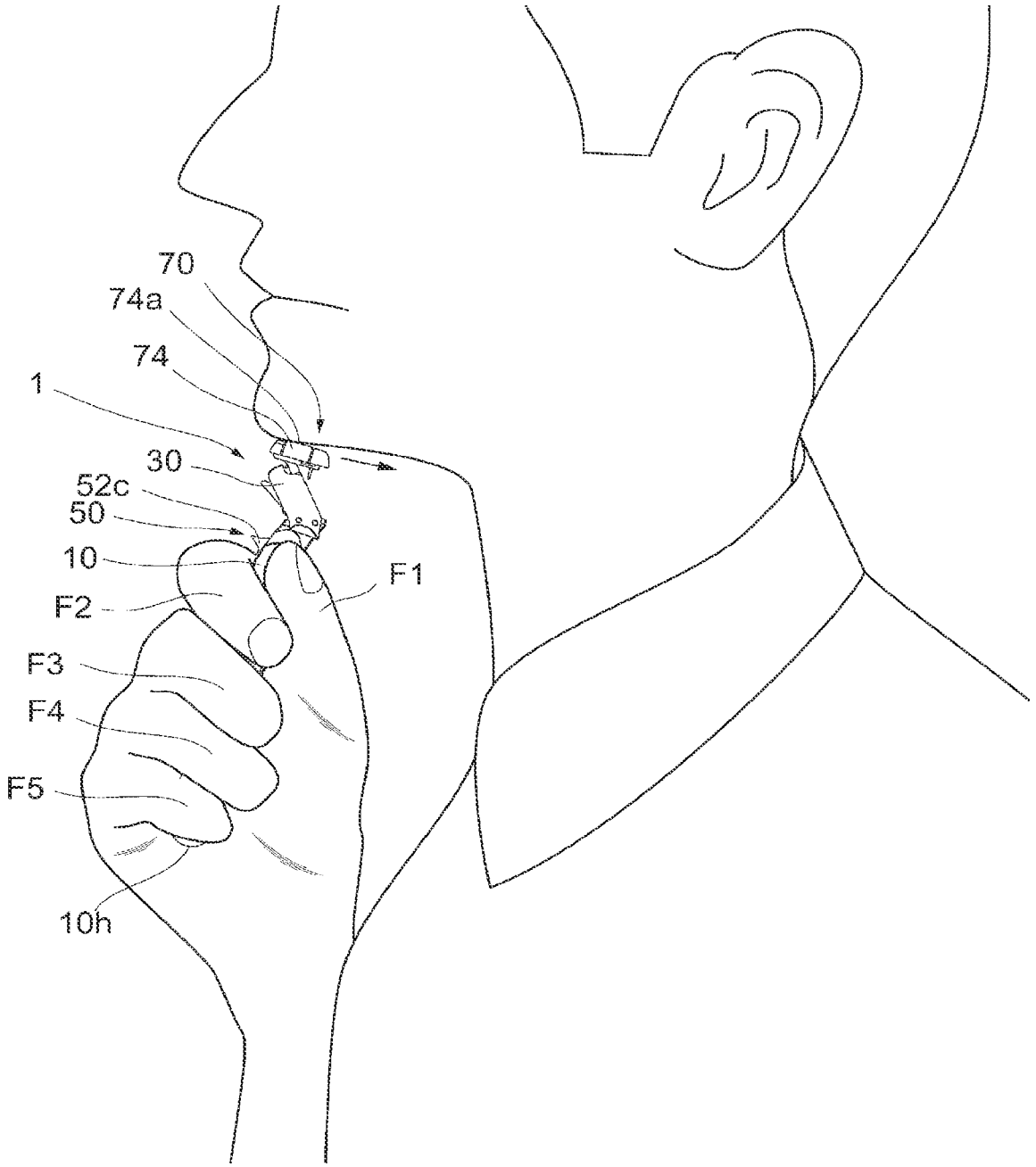
FIG. 15 is a view illustrating a first use mode in which a part under the chin is forward-shaved by the handle bending razor in the bent state of this embodiment.

Subsequently, a use mode of the handle bending razor 1 according to this embodiment will be explained by using four typical examples. FIG. 15 is a view illustrating a first use mode of the forward shaving under the chin by the handle bending razor in the bent state of this embodiment.

In the first use mode, when the beard under the chin is to be shaved in the forward shaving, the user grips the grip portion 10 such that the fingertips of the thumb (first finger) F1, the forefinger (second finger) F2, and the middle finger (third finger) F3 are put on an upper front side of the grip portion 10, for example. At this time, the fingertips of the ring finger (fourth finger) F4 and the little finger (fifth finger) F5 touch a lower front side of the grip portion 10, but since the recess portion 10*a* is formed on the lower front side of the grip portion 10, the balls of the fingertips of the ring finger (fourth finger) F4 and the little finger (fifth finger) F5 can be placed on the recessed portion 10*a* easily.

As a result, since the user can grip (hold) the grip portion 10 in a state where some fingers such as the ring finger F4 or the little finger F5 are bent (closed), it becomes easier for the user to hold the grip portion 10. Moreover, since operability of the handle bending razor 1 by the user can be improved, the shaving can be performed stably without shaking the handle bending razor 1.

Moreover, in the first use mode, since the user is using the handle bending razor 1 in the bent state, the contact surface 74*a* of the razor head 70 can be brought into contact with under the chin at a target angle of the right angle or close to the right angle. As a result, when the user moves the razor head 70 to a direction getting closer to the throat while causing the contact surface 74*a* in contact with under the chin, contact by the lower end 10*h* of the grip portion 10 with the user's body can be suppressed. That is, when the beard under the chin is to be shaved in the forward shaving, the user can shave a wide range under the chin in the forward shaving without causing the lower end 10*h* of the grip portion 10 to touch the user's body.

<Second Use Mode: Reverse Shaving under the Chin in Bent State>

Figure 16:
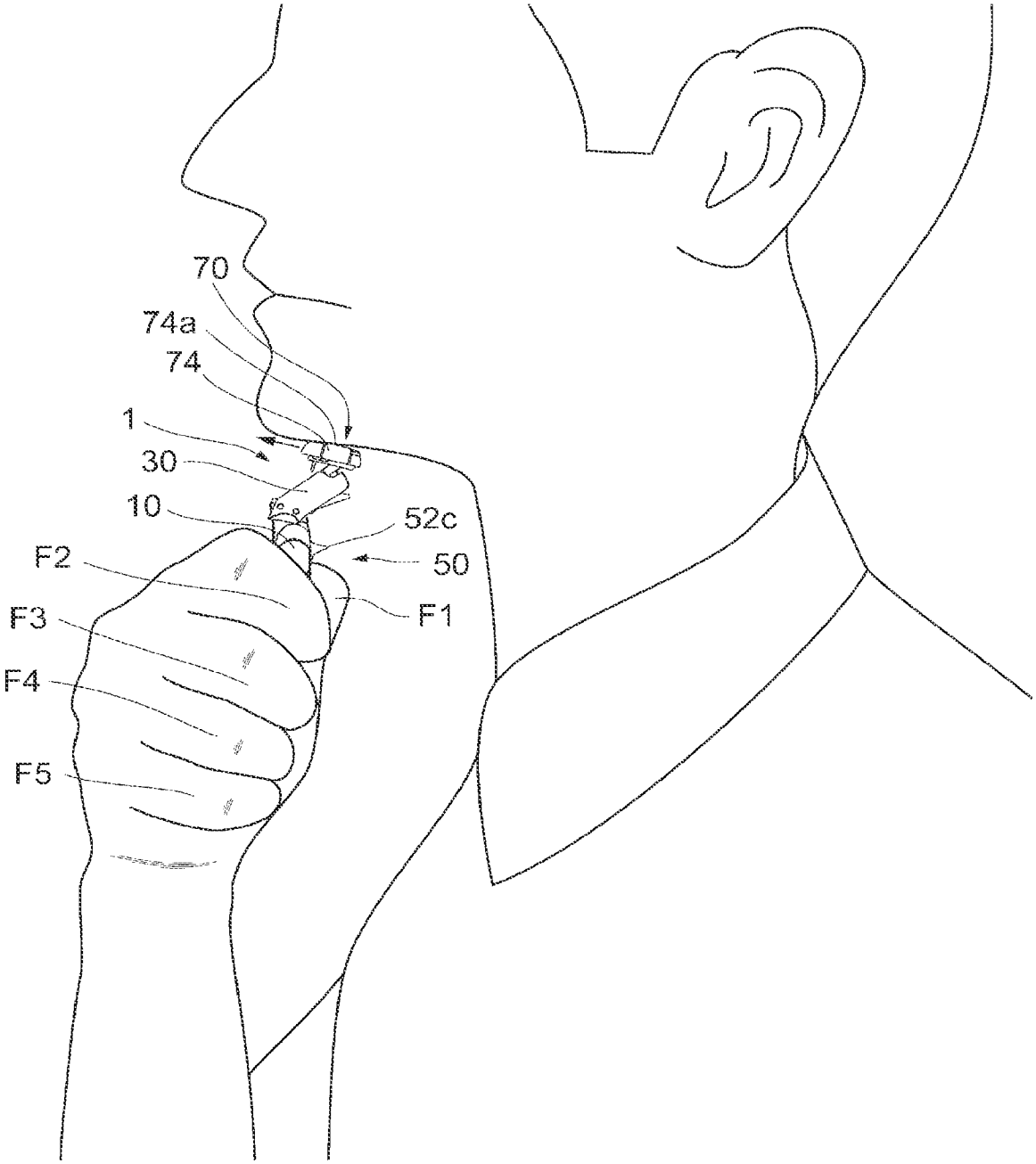
FIG. 16 is a view illustrating a second use mode in which the part under the chin is reverse-shaved by the handle bending razor in the bent state of this embodiment.

FIG. 16 is a view illustrating a second use mode in which under the chin is reverse-shaved by the handle bending razor in the bent state of this embodiment. In the second use mode, the handle bending razor 1 is used in the bent state. When the beard under the chin is to be shaved in the reverse shaving, the user grips the grip portion 10 by putting the fingertip of the forefinger F2 on the upper right side of the grip portion 10 while placing the fingertip of the thumb F1 on the upper rear side of the grip portion 10, for example. Then, the lower part of the grip portion 10 is gripped by the remaining middle finger F3, the ring finger F4, and the little finger F5. At this time, the balls close to the second joints of the ring finger F4 and the little finger F5 touch the lower front side of the grip portion 10 but since the recessed portion 10*a* is formed on the lower front side of the grip portion 10, the balls close to the second joints of the ring finger F4 and the little finger F5 can be placed on the recessed portion 10*a* easily.

As a result, since the user can grip (hold) the grip portion 10 in the state where some fingers such as the ring finger F4 or the little finger F5 are bent (closed), it becomes easier for the user to hold the grip portion 10. Moreover, since operability of the handle bending razor 1 by the user can be improved, shaving can be performed stably without shaking the handle bending razor 1.

Moreover, the user can switch between the direction of the handle bending razor 1 suitable for the forward shaving (first use mode) and the direction of the handle bending razor 1 suitable for the reverse shaving (second use mode) only by rotating the grip portion 10 around an axis along the longitudinal direction in the palm. That is, with a conventional razor with a small target angle, when the direction of the razor suitable for the forward shaving and the direction of the razor suitable for the reverse shaving are to be switched, re-holding of the handle is needed in some cases so that the handle becomes upside-down. On the other hand, with the handle bending razor 1 of this application, since the target angle can be a right angle or an angle close to the right angle, the direction of the handle bending razor 1 suitable for the forward shaving and the direction of the handle bending razor 1 suitable for the reverse shaving can be switched with a simple operation of rotating the grip portion 10 around the axis along the longitudinal direction by 180°, for example.

<Third use mode: Reverse Shaving of Cheek in Bent State>

Figure 17:
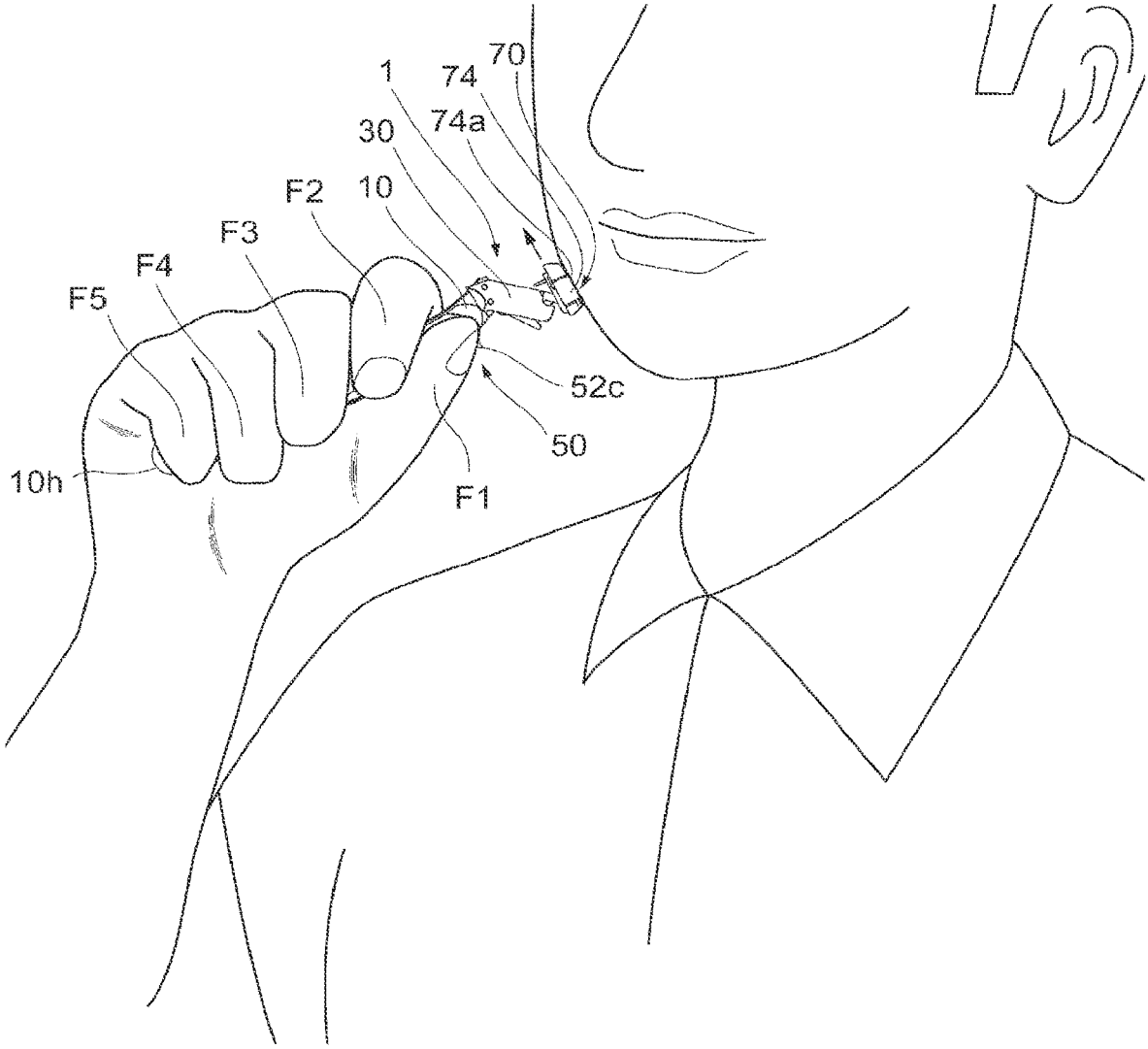
FIG. 17 is a view illustrating a third use mode in which a cheek is reverse-shaved by the handle bending razor in the bent state of this embodiment.

FIG. 17 is a view illustrating a third use mode in which the cheek is reverse-shaved by the handle bending razor in the bent state of this embodiment. In the third use mode, the handle bending razor 1 is used in the bent state. When the beard on the cheek is to be shaved in the reverse shaving, similarly to the second use mode, the user grips the grip portion 10 by placing the fingertip of the forefinger F2 on the upper right side of the grip portion 10, while putting the fingertip of the thumb F1 on the upper rear side of the grip portion 10, for example. Then, the lower part of the grip portion 10 is gripped by the remaining middle finger F3, the ring finger F4, and the little finger F5.

In the third use mode, since the user uses the handle bending razor 1 in the bent state, the user can bring the contact surface 74*a* of the razor head 70 into contact with the skin of the cheek at a target angle of the right angle or close to the right angle. As a result, the user can move the contact surface 74*a* on the skin of the user's cheek in the state where the grip portion 10 extends to the lower direction. That is, when the grip portion 10 was used upside-down as conventional, the user's elbow tended to be raised easily, but in the third use mode, the use in the state where the grip portion 10 extends to the lower direction can be realized. Thus, more comfortable use than before can be realized in the state where the user's elbow is not raised.

<Fourth Use Mode: Forward Shaving of Cheek in Before-bending State>

Figure 18:
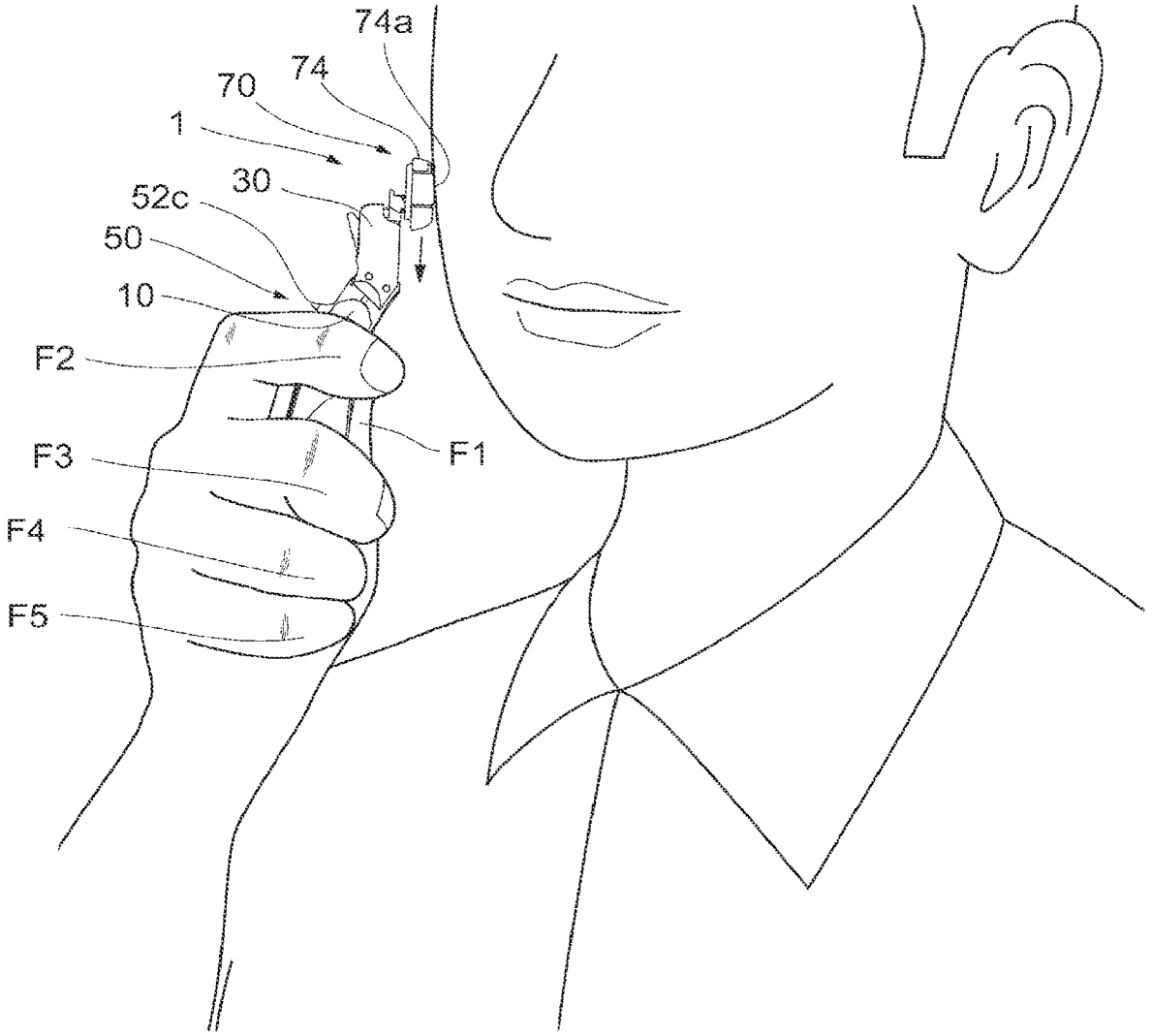
FIG. 18 is a view illustrating a fourth use mode in which the cheek is forward-shaved by the handle bending razor in the before-bending state of this embodiment.

FIG. 18 is a view illustrating a fourth use mode in which the cheek is forward-shaved by the handle bending razor in the before-bending state of this embodiment. In the fourth use mode, the handle bending razor 1 is used in the before-bending state. When the beard under the chin is to be shaved in the forward shaving, the user grips the grip portion 10 by placing the fingertip of the forefinger F2 on the upper front side of the grip portion 10, while putting the fingertip of the thumb F1 on the upper right side of the grip portion 10. Then, the lower part of the grip portion 10 is gripped by the remaining middle finger F3, the ring finger F4, and the little finger F5. At this time, the balls close to the second joints of the ring finger F4 and the little finger F5 touch the lower front side of the grip portion 10 but since the recessed portion 10*a* is formed on the lower front side of the grip portion 10, the user can cause the balls close to the second joints of the ring finger F4 and the little finger F5 to touch the recessed portion 10*a* easily.

In the fourth use mode, since the user is using the handle bending razor 1 in the before-bending state, the contact surface 74*a* of the razor head 70 can be brought into contact with the skin of the cheek at the target angle of 10° or close to 10°, that is, in a state where the contact surface 74*a* is substantially parallel to the up-down direction. As a result, the user can move the contact surface 74*a* on the skin of the user's cheek in the state where the grip portion 10 extends to the lower direction.

In the case of shaving using the first to fourth use modes described above, it is assumed that the user changes the use mode in the order of the fourth use mode, the first use mode, the second use mode, and the third use mode. At this time, the user forward-shaves the cheek in the before-bending state (fourth use mode), changes to the bent state and forward-shaves the lower chin (first use mode), rotates the grip portion 10 around the axis along the longitudinal direction and reverse-shaves under the chin in the bent state (second use mode), and reverse-shaves the cheek as it is (third use mode). By shaving in the order as described above, in the case of shaving in the forward-shaving from the cheek to under the chin, the shaving can be done by performing only one simple operation of changing the state from the before-bending state to the bent state. In the case of the shaving in the reverse-shaving from under the chin to the cheek, the shaving can be done by performing a simple operation of rotating the grip portion 10 around the axis along the longitudinal direction by 180°, for example, without performing a cumbersome operation of re-holding the grip portion 10 so that the grip portion 10 extends to the upper direction.

<2. Variation>

Subsequently, a variation of the embodiment of the present invention will be explained. This variation is different from the embodiment in the shape of the grip portion and the like. In the following explanation, differences from the embodiment will be explained, while explanation on parts in common with the embodiment will be omitted.

<Configuration of Handle Bending Razor 2>

Figure 19:
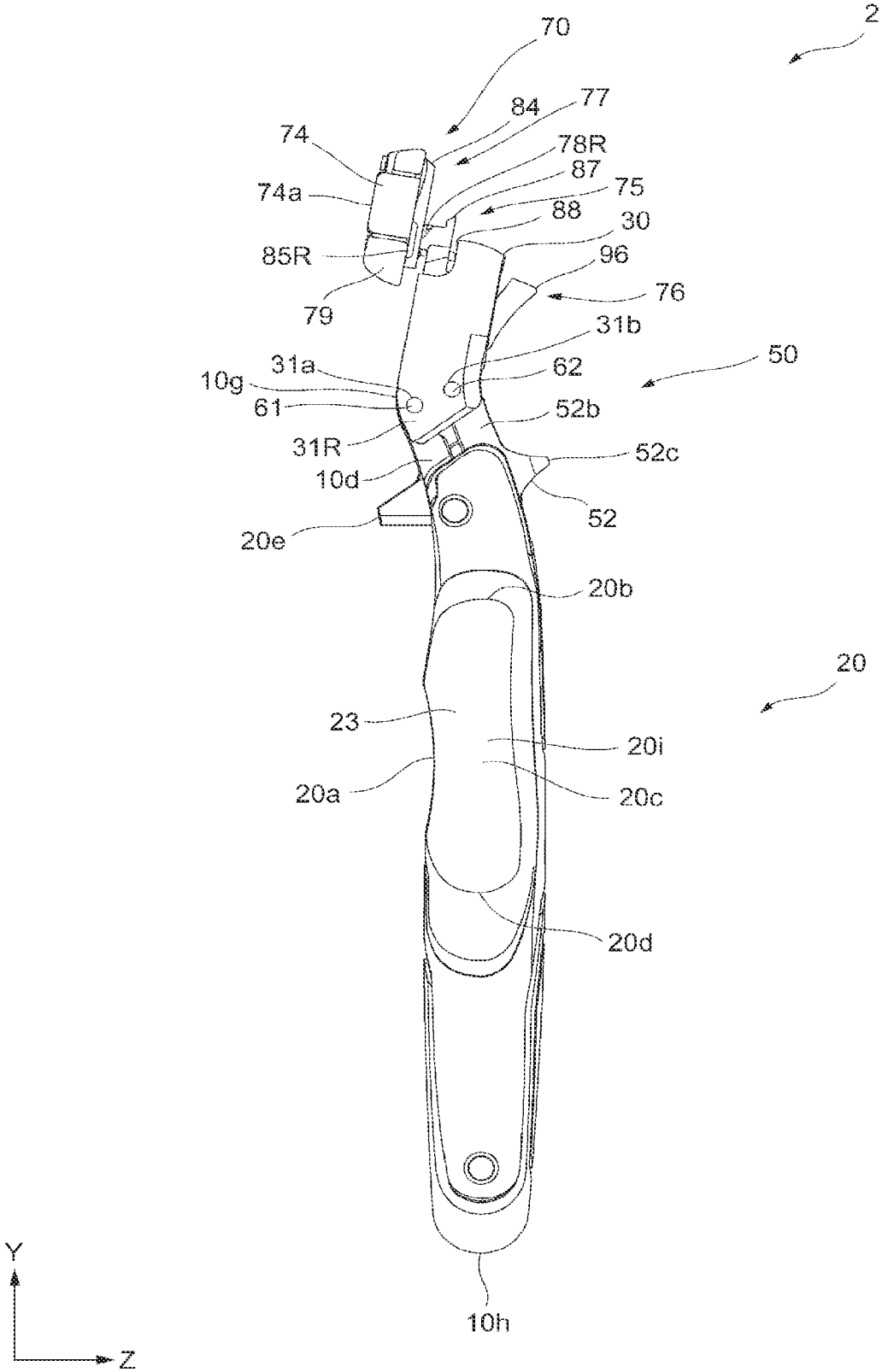
FIG. 19 is a plan view of the handle bending razor in the before-bending state of a variation of the embodiment, when viewed from the right side.
Figure 20:
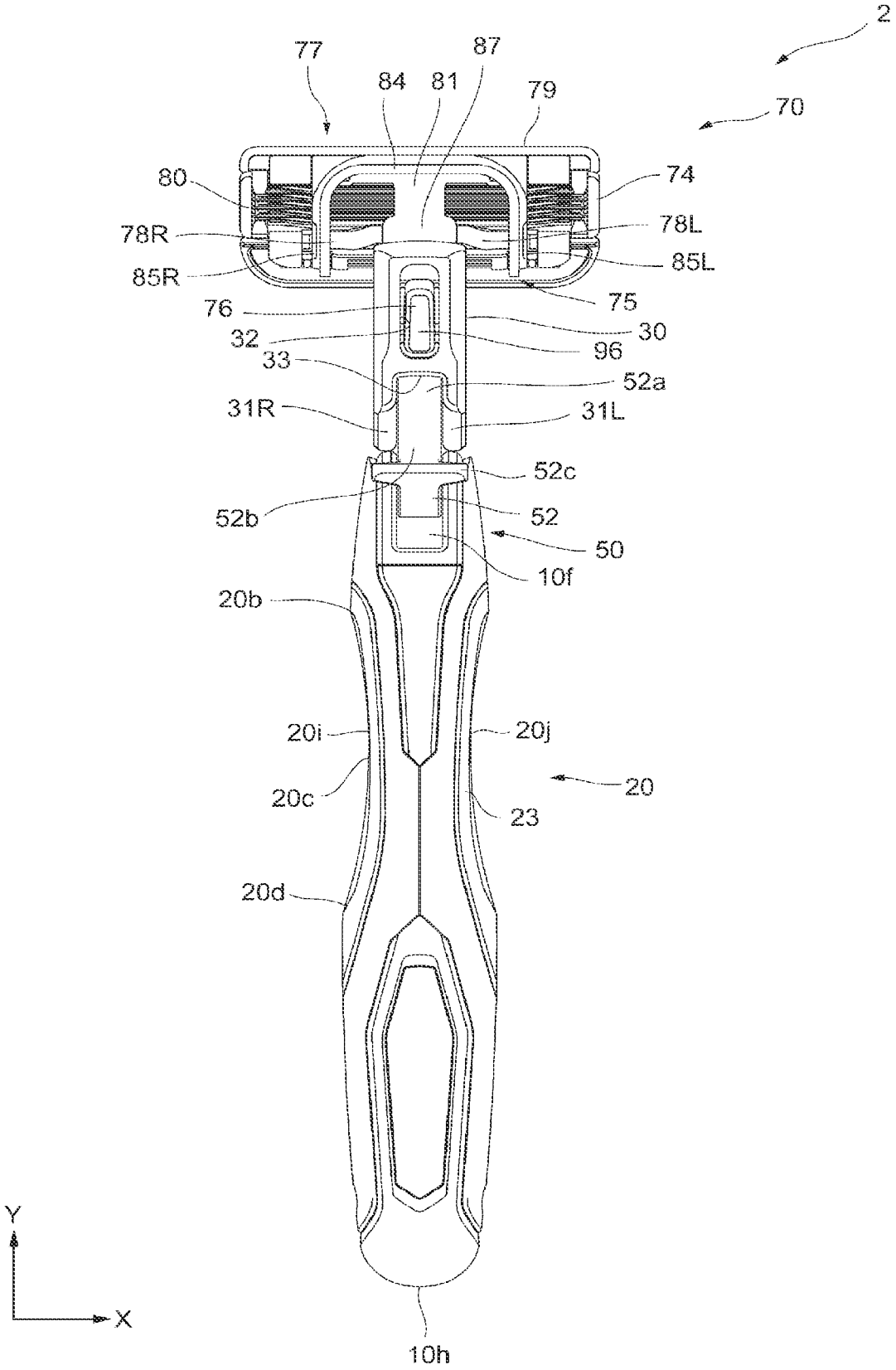
FIG. 20 is a plan view of the handle bending razor in the before-bending state of the variation of the embodiment, when viewed from the rear side.

FIG. 19 is a plan view of a handle bending razor in the before-bending state of the variation of the embodiment, when viewed from the right side. FIG. 20 is a plan view of the handle bending razor in the before-bending state of the variation of the embodiment, when viewed from the rear side.

As shown in FIGS. 19 and 20, the handle bending razor 2 of the variation of the embodiment includes a grip portion 20 instead of the grip portion 10 as compared with the handle bending razor 1 shown in FIG. 1. Substantially at a center of the grip portion 20, a non-slip member 23 formed of an elastomer, for example, is mounted from a right side to a left side through a front side.

<Recessed Portion 20*a*>

On the grip portion 20, when viewed on a plan view from the left-right direction, a recessed portion 20*a* is formed between the upper end 10*g* and the lower end 10*h* (see FIG. 19). The recessed portion 20*a* is formed substantially at the center in the up-down direction of the grip portion 20 and is recessed to the rear side. A length in the up-down direction of the recessed portion 20*a* is smaller than the length in the up-down direction of the recessed portion 10*a* of the handle bending razor 1 in the embodiment. It is to be noted that the length in the up-down direction of the recessed portion 20*a* may be equal to or larger than the length in the up-down direction of the recessed portion 10*a* of the handle bending razor 1 of the embodiment.

In the case of the forward shaving by the user, for example, the ball of the finger top of the middle finger touches the front side substantially at the center of the grip portion 20, and since the recessed portion 20*a* is formed, the ball of the fingertip of the middle finger touches the recessed portion 20*a*, which makes holding of the handle bending razor 2 easier, and operability of the handle bending razor 2 can be improved.

Moreover, when the user performs the reverse shaving without turning the handle bending razor 2 upside-down, for example, the ball close to the second joint of the middle finger touches the front side substantially at the center of the grip portion 20. At this time, since the recessed portion 20*a* is formed, the ball close to the second joint of the middle finger touches the recessed portion 20*a*, which makes holding of the handle bending razor 2 easier, and operability of the handle bending razor 2 can be improved.

<Right-Side Recessed Portion 20*i* and Left-Side Recessed Portion 20*j*>

When the handle bending razor 2 is seen on a plan view from the front-back direction, a part of a space between the upper end 10*g* and the lower end 10*h* is narrowed. In this variation, the vicinity of the upper end 10*g* of the grip portion 20 is an upper-side wide-width portion 20*b* whose width in the left-right direction is wide when seen on a plan view form the front-back direction. On a lower side of the upper-side wide-width portion 20*b* and in the vicinity of the recessed portion 20*a*, there is a narrow-width portion 20*c* whose width in the left-right direction is narrow when seen on a plan view from the front-back direction. And on the lower side of the narrow-width portion 20*c*, when seen on a plan view from the front-back direction, there is a lower-side wide-width portion 20*d* whose width in the left-right direction is wide.

That is, when the handle bending razor 2 is seen on a plan view from the front-back direction, a right-side recessed portion 20*i* and a left-side recessed portion 20 are formed on the right side and the left side, respectively, from the upper-side wide-width portion 20*b* to the lower-side wide-width portion 20*d*. The shapes of the right-side recessed portion 20*i* and a shape of the left-side recessed portion 20*j* are bilaterally symmetric.

As described above, by forming the space between the upper-side wide-width portion 20*b* and the lower-side wide-width portion 20*d* in a constricted shape, in the case of gripping by the user at any position between the upper-side wide-width portion 20*b* and the lower-side wide-width portion 20*d*, when the user applies a downward force, slip of the user's hand on the grip portion 20 can be suppressed.

<Protruding Portion 20*e*>

As shown in FIG. 19, in the vicinity of the protruding portion 10*d* of the grip portion 20, on a side opposite to the operation portion 22*c*, a protruding portion 20*e* protruding toward the front side is formed. The protruding portion 20*e* has a distal end part protruding the most toward the Z-axis–side on both end parts in the left-right direction, respectively, and has a shape similar to a Y-shape in which a recess is provided between these two distal end parts. As described above, by forming the protruding portion 20*e*, when the handle bending razor 2 is placed on the loading surface so that the contact surface 74*a* is faced downward, for example, the handle bending razor 2 is supported at three points of the two distal end parts of the protruding portion 20*e* and the lower end 10*h* of the grip portion 20. As a result, since contact of the lower end of the razor head 70 with the loading surface can be prevented, adhesion of the shaving aid mounted on the contact surface 74*a* of the upper part 79*b* and the lower part 79*c* of the frame portion 79 to the loading surface or damage to the blade edge 80*a* of the blade body 80 can be prevented. Moreover, adhesion of dirt on the loading surface to the contact surface 74*a* of the razor head 70 and transfer of the dirt to the skin of the user can be suppressed. Furthermore, since a configuration of support at the three points is realized, the handle bending razor 2 can be stably supported.

2. Features of this Embodiment

As described above, specific examples have been explained by the embodiment and the variation, and the handle bending razors 1 and 2 described in this Description have features as follows.

The handle bending razors 1 and 2 are configured such that the angle formed by the contact surface 74*a* and the up-down direction in which the grip portion 10 extends can be changed by the user's operation. Specifically, it is configured such that, when the blade assembly body 74 is at the neutral position not subject to the external force, the before-bending state (first state) in which the neutral angle formed by the contact surface 74*a* and the up-down direction is $\alpha f$, and the contact surface 74*a* and the up-down direction are substantially parallel and the bent state (second state) in which the neutral angle is as, which is larger than $\alpha f$, can be switched by the switching mechanism 50. Moreover, in the bent state, when the external force is applied, the blade assembly body is tiltable to a position where the contact surface 74*a* and the up-down direction become at least substantially perpendicular (90°).

By means of the configuration as above, when the user shaves the cheek in the forward shaving, for example, by having the before-bending state in which the contact surface 74*a* and the up-down direction are substantially parallel, the contact surfacer 74*a* can be moved on the skin of the user's cheek in the state where the grip portion 10 extends to the lower direction.

Moreover, when the user shaves under the chin in the forward shaving, for example, by having the bent state in which the neutral angle is as, which is larger than $\alpha f$, the contact surface 74*a* can be brought into close contact with the user's skin under the chin without interference of the lower end 10*h* of the grip portion 10 with the user's body and in the state where the grip portion extends to the lower direction. And when the user applies the force to the grip portion 10 so as to press the contact surface 74*a* onto the skin, the blade assembly body 74 is tilted to the position where the contact surface 74*a* and the up-down direction become substantially perpendicular, and the contact surface 74*a* can be reliably brought into contact with the skin under the user's chin in the state where the grip portion 10 extends to the lower direction, while the lower end 10*h* of the grip portion 10 is kept away from the user's body. When the user moves the razor to the front side in this state, the contact surface 74*a* can be moved while kept in close contact on the skin under the user's chin in the state where the grip portion 10 extends to the lower direction.

Moreover, when the user shaves the cheek in the reverse shaving, for example, by having the bent state, a part of the contact surface 74*a*, that is, the upper end, for example, can be caused to touch the skin of the user's cheek in the state where the grip portion 10 extends to the lower direction. And when the user applies the force to the grip portion 10 so as to press the contact surface 74*a* onto the skin, the blade assembly body 74 is tilted to the position where the contact surface 74*a* and the up-down direction become substantially perpendicular, and the contact surface 74*a* can be brought into close contact with the skin of the user's cheek in the state where the grip portion 10 extends to the lower direction. When the user moves the razor 1 to the front side in this state, the contact surface 74*a* can be moved on the skin of the user's cheek in the state where the grip portion 10 extends to the lower direction.

Moreover, when the user shaves under the chin in the reverse shaving, for example, by having the bent state, the contact surface 74*a* can be brought into contact with the skin under the user's chin in the state where the grip portion 10 extends to the lower direction, without raising the elbow much. When the user moves the razor 1 to the front side, too, the movement can be performed with the contact surface 74*a* in close contact on the skin under the user's chin in the state where the grip portion 10 extends to the lower direction. It is to be noted that, when the user shaves under the chin in the reverse shaving, even in the before-bending state, the contact surface 74*a* can be brought into close contact with the skin under the user's chin in the state where the grip portion 10 extends to the lower direction. However, if the part under the chin is reverse-shaved in the bent state, the user can perform shaving without raising the elbow much and thus, the part under the chin can be shaved more comfortably. Moreover, the forward shaving under the chin, the reverse shaving under the chin, and the reverse shaving of the cheek can be continuously performed in the bent state.

That is, in either case of the forward shaving and the reverse shaving, the contact surface 74*a* can be moved on the user's skin and on the skin under the chin in the state where the grip portion 10 extends to the lower direction. Therefore, the forward shaving and the reverse shaving can be performed easily for the user without re-holding the grip portion 10 so that the grip portion 10 extends to the upper direction.

Moreover, in the handle bending razors 1 and 2, the blade assembly body 74 is configured tiltably so that the neutral angle $\alpha f$ is set at 5° or more and 25° or less in the before-bending state and the angle formed by the contact surface 74*a* and the up-down direction is 80° or more when the external force such as pressing onto the skin by the user is applied in the bent state. By means of this configuration, in the before-bending state, when the user shaves the cheek in the forward shaving, the neutral angle suitable for the contact surface 74*a* to be brought into contact with the user's cheek can be realized in the state where the grip portion 10 extends to the lower direction. On the other hand, in the bent state, since the blade assembly body 74 is tilted so that the angle formed by the contact surface 74*a* and the up-down direction is 80° or more, when the user shaves under the chin in the forward shaving, the state in which the contact surface 74*a* is reliably in close contact with the skin under the user's chin can be realized while the lower end of the grip portion 10 is kept away from the user's body, and in a state where the grip portion 10 extends to the lower direction. Moreover, when the user shaves the cheek and under the chin in the reverse shaving, the state where the contact surface 74*a* is in close contact with the skin of the user's cheek can be realized in the state the grip portion 10 extends to the lower direction.

Moreover, in the handle bending razors 1 and 2, the switching mechanism 50 includes the operation portion 52*c* and the movable body 52, the movable 52 has its movement regulated, and when the user presses down the operation portion 52*c*, the regulation on the movement of the movable body 52 is released, and the movement between the before-bending position and the bent position is enabled. With this configuration, when the razor is moved to the front side in use, even if the external force to move the blade assembly body 74 from the position in the before-bending state (before-bending position) to the position in the bent state (bent position) is applied to the blade assembly body 74, since the movement of the movable body 52 is regulated, an unexpected change to the bent state of the razor in the before-bending state can be suppressed. As a result, the razor can be stably used. Moreover, the user can change a state of the razor from the before-bending state to the bent state with a simple operation of pressing down the operation portion 52*c*.

Moreover, in the handle bending razors 1 and 2, the difference between the before-bending angle and the bent angle is preferably 20° or more and 40° or less. According to this, the angle of the contact surface suitable for the forward shaving of the cheek in the before-bending state is realized, and the angle of the contact surface suitable for the forward shaving and the reverse shaving under the chin and suitable for the reverse shaving of the cheek in the bent state can be realized.

Moreover, in the handle bending razors 1 and 2, it is configured such that the groove 10*f* which accommodates a part of the movable body 52 is formed on the grip portion 10, and the width in the left-right direction of the operation portion 52*c* is larger than the width in the left-right direction of the groove 10*f*. As a result, operability of the operation portion 52*c* by the user can be improved.

3. Supplementary Items

Specific explanation has been made as above for the embodiment and the variation of the present invention. The aforementioned explanation is only explanation as a configuration example and an operation example, and a scope of the present invention is not limited to these embodiment and variation but should be interpreted widely to a range that persons ordinarily skilled in the art can grasp on the basis of similar technical ideas.

When "perpendicular" or "substantially perpendicular" is referred to in this Description, it does not refer only to a case in which an angle formed by one and the other is 90° but in a range not departing from the gist of the invention, it is to include those with an angle formed by the one and the other at 60°, for example. Moreover, when "parallel" or "substantially parallel" is referred to, it does not refer only to a case in which an angle formed by one and the other is 0° but in a range not departing from the gist of the invention, it is to include those with an angle formed by the one and the other at 30°, for example.

Moreover, the handle bending razor of the present invention is particularly suitable as a razor for face-shaving described in the embodiment but can also be used for portions other than the face. The handle bending razor of the present invention is useful for shaving underarm hair, pubic hair, leg hair and the like. In use for those portions, too, by switching the before-bending state and the bent state of the grip portion 10, the razor can be easily brought into close contact with the skin. Moreover, the razor can be easily brought into close contact with an intended portion by the user without taking a forced posture such as raising the elbow or twisting the wrist.

The razor of the present invention is suitably applied as a razor usable for an user without re-holding the handle upside-down.

1, 2 Handle bending razor
10, 20 Grip portion
30 Head coupling portion
32 Through hole
33 Groove
50 Switching mechanism
51 Torsion coil spring
52 Movable body
61 Coupling pin for bending
62 Coupling pin for switching
63 Regulating pin
70 Razor head
74 Blade assembly body
74*a* Contact surface
75 Elastic support body
76 Connecting portion
77 Support portion
80 Blade body
80*a* Blade edge

What is claimed is:

1. A handle bending razor, comprising:

a grip portion extending in an up-down direction and capable of being gripped by a user;

a razor head extending in a left-right direction;

a head coupling portion coupled with an upper end of the grip portion rotatably around a rotating shaft extending in the left-right direction crossing the up-down direction and coupled with the razor head, wherein the razor head comprises:

a blade body with the left-right direction as a longitudinal direction;

a blade assembly body having a contact surface brought into contact with the user's skin together with the blade body and to which the blade body is assembled;

a connecting portion connected to the head coupling portion; and an elastic support body which is provided between the connecting portion and the blade assembly body and supports the blade assembly body tiltably in the up-down direction and a front-back direction crossing the left-right direction; and a switching mechanism coupled to the head coupling portion for changing an angle formed by the contact surface and the up-down direction by an operation by the user and, when the blade assembly body is at a neutral position where an external force is not applied, switches between a first state in which a neutral angle formed by the contact surface and the up-down direction is a first angle and the contact surface and the up-down direction become substantially parallel and a second state in which the neutral angle becomes a second angle larger than the first angle is provided, wherein in the second state, when the external force is applied, the blade assembly body is tiltable to a position where the contact surface and the up-down direction become at least substantially perpendicular, wherein the switching mechanism has an operation portion exposed to an outer side of the grip portion and includes a movable body moving between a first position where the first state is maintained and a second position where the second state is maintained, wherein the movable body has movement from the first position to the second position regulated, and wherein the regulation on the movement of the movable body from the first position to the second position is released by pressing-down on the operation portion by the user.

2. The handle bending razor according to claim 1, wherein in the case of forward shaving, by having the first state, the contact surface can move on a skin of the user's cheek in the state where the grip portion extends to a lower direction and by having the second state, the contact surface can move on the skin under the user's chin without interference of a lower end of the grip portion with the user's body, and wherein in the case of reverse shaving, by having the second state, the contact surface can move on the skin of the user's cheek in the state where the grip portion extends to the lower direction.

3. The handle bending razor according to claim 1, wherein the first angle is in the range from 5° to 25°, and wherein in the second state, when the external force is applied, the blade assembly body is tiltable such that the second angle formed by the contact surface and the up-down direction becomes 80° or more.

4. The handle bending razor according to claim 1, wherein a difference between the second angle and the first angle is in the range from 20° to 40°.

5. The handle bending razor according to claim 1, wherein in the grip portion, a groove accommodating a part of the movable body is formed along the up-down direction, and wherein a width in the left-right direction of the operation portion is larger than a width in the left-right direction of the groove.

6. The handle bending razor according to claim 1, wherein in the first state, a first direction from the rotating shaft to the elastic support body is substantially parallel to the up-down direction in which the grip portion extends, and wherein in the second state, a second direction from the rotating shaft to the elastic support body is directed to a rear side, which is a side opposite to the front side to which a blade edge of the blade body in the first state can be exposed as compared with the first direction.

7. The handle bending razor according to claim 1, wherein the grip portion has a part recessed and formed on a front side of the grip portion and between the upper end and a lower end of the grip portion when viewed on a plan view from the left-right direction.

8. The handle bending razor according to claim 1, wherein in the grip portion, at least a part of an outer periphery between the upper end and a lower end of the grip portion is smaller than an outer periphery of the lower end.

* * * * *